US010044085B2

(12) United States Patent
Ma et al.

(10) Patent No.: US 10,044,085 B2
(45) Date of Patent: Aug. 7, 2018

(54) STRETCHABLE TRANSMISSION LINES AND CIRCUITS FOR MICROWAVE AND MILLIMETER WAVE FREQUENCY WEARABLE ELECTRONICS

(71) Applicant: Wisconsin Alumni Research Foundation, Madison, WI (US)

(72) Inventors: Zhenqiang Ma, Middleton, WI (US); Yei Hwan Jung, Madison, WI (US); Juhwan Lee, Madison, WI (US); Shaoqin Gong, Middleton, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 184 days.

(21) Appl. No.: 15/098,636

(22) Filed: Apr. 14, 2016

(65) Prior Publication Data

US 2017/0301432 A1 Oct. 19, 2017

(51) Int. Cl.

| | |
|---|---|
| ***H01P 3/08*** | (2006.01) |
| ***H01B 11/04*** | (2006.01) |
| ***H01P 11/00*** | (2006.01) |

(52) U.S. Cl.

CPC ..... *H01P 3/08* (2013.01); *H01P 11/003* (2013.01)

(58) Field of Classification Search

CPC ..... H01B 11/02; H01B 11/04; H01P 3/08

See application file for complete search history.

(56) References Cited

U.S. PATENT DOCUMENTS 5,036,160 A 7/1991 Jackson
6,300,846 B1 * 10/2001 Brunker ..... H01B 7/0876 333/1
6,373,740 B1 4/2002 Forbes et al.
6,444,490 B2 * 9/2002 Bertin ..... H01L 23/49524 257/E23.034
6,553,555 B1 * 4/2003 Green ..... G06F 17/5077 361/737
7,271,985 B1 9/2007 Buhler et al.
8,119,919 B2 * 2/2012 Tagi ..... H05K 1/0228 174/254
8,207,473 B2 * 6/2012 Axisa ..... B32B 37/185 174/254

(Continued)

FOREIGN PATENT DOCUMENTS

GB 2369727 6/2002
JP 2004227891 8/2004

OTHER PUBLICATIONS

J. Coonrod, Choosing Circuit Materials for Millimeter Wave Applications, High Frequency Electronics, Jul. 2013.

(Continued)

*Primary Examiner* — Dean Takaoka
*Assistant Examiner* — Alan Wong
(74) *Attorney, Agent, or Firm* — Bell & Manning, LLC

(57) ABSTRACT

Stretchable high frequency transmission lines and high-frequency filters comprising the transmission lines are provided. The transmission lines provide low power loss, even at microwave and millimeter wave frequencies. The transmission lines are thin and flexible and can be stretched without a significant degradation of their scattering parameters. As a result, the transmission lines have applications as interconnects in stretchable and flexible integrated circuits (IC) and circuit device components, such as flexible transistors and flexible diodes.

16 Claims, 34 Drawing Sheets

(56) References Cited

U.S. PATENT DOCUMENTS

| | | | |
|---|---|---|---|
| 8,384,489 | B2 | 2/2013 | Park et al. |
| 8,933,769 | B2 | 1/2015 | Houck et al. |
| 9,247,648 | B2 | 1/2016 | Vanfleteren et al. |
| 9,288,893 | B2 * | 3/2016 | Karikalan ..... H05K 1/0245 |

OTHER PUBLICATIONS

Ponchak et al., Characterization of Thin Film Microstrip Lines on Polyimide, IEEE Transactions on Components, Packaging, and Manufacturing Technology Part B, vol. 21, No. 2, May 1998, pp. 171-176.

Hussain et al., Metal/Polymer Based Stretchable Antenna for Constant Frequency Far-Field Communication in Wearable Electronics, Adv. Funct. Mater. 2015, 25, Oct. 6, 2015, pp. 6565-6575.

Maloratsky, Using Modified Microstrip Lines to Improve Circuit Performance, High Frequency Electronics, Mar. 2011.

Hocheng et al., Design, Fabrication and Failure Analysis of Stretchable Electrical Routings, Sensors 2014, 14, Jul. 4, 2014, pp. 11855-11877.

Huyghe et al., Design and Manufacturing of Stretchable High-Frequency Interconnects, IEEE Transactions on Advanced Packaging, vol. 31, No. 4, Nov. 2008, pp. 802-808.

Xu et al., Stretchable batteries with self-similar serpentine interconnects and integrated wireless recharging systems, Nature Communications 4:1543, Feb. 26, 2013, pp. 1-28.

Zhang et al., Buckling in serpentine microstructures and applications in elastomer-supported ultra-stretchable electronics with high areal coverage, Soft Matter, Jun. 27, 2013, 9, pp. 8062-8070.

Jeon et al., Electrical Characterization of Differential Stretchable Transmission Line, Microwave Symposium Digest (MTT), 2011 IEEE MTT-S International , Jun. 5, 2011.

* cited by examiner

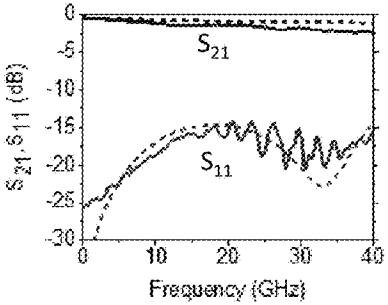
FIG. 12A
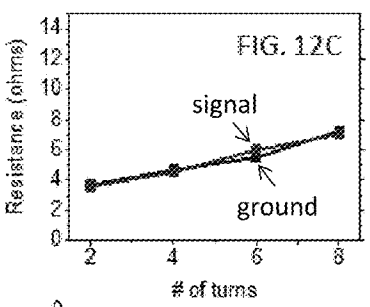
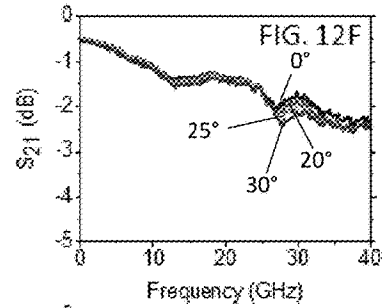

Group delay (ps)
150
100
50
0
-50
5
10
15
20
25
30
35
Frequency (GHz)

S21,S11 (dB)
0
-5
-10
-15
-20
-25
-30
0
10
20
30
40
Frequency (GHz)
S11
S21
0%
20%
25%
35%

Group delay (ps)
150
100
50
0
-50
5
10
15
20
25
30
35
Frequency (GHz)

S21,S11 (dB)
0
-5
-10
-15
-20
-25
-30
0
10
20
30
40
Frequency (GHz)
S11
S21
0%
20%
25%
35%

STRETCHABLE TRANSMISSION LINES AND CIRCUITS FOR MICROWAVE AND MILLIMETER WAVE FREQUENCY WEARABLE ELECTRONICS

REFERENCE TO GOVERNMENT RIGHTS

This invention was made with government support under FA9550-09-1-0482 awarded by the USAF/AFOSR. The government has certain rights in the invention.

BACKGROUND

The remarkable mechanical properties of stretchable electrical interconnects have enabled the integration of high-performance electronic devices in a myriad of applications. In particular, the unique design and integration of stretchable interconnects have led to wearable electronics, the so-called "epidermal electronic system" (EES), that match their physical properties to the epidermis for conformal relief on its surface. Together with state-of-the-art performance inorganic semiconductor devices, stretchable interconnects have transformed rigid- and flat-based electronics into highly stretchable EESs, ranging from various types of epidermal sensors to photonic devices. However, studies on stretchable interconnects have been limited to designs primarily for electrical operation at direct current (DC) signals or alternating current (AC) signals at very low frequencies, where the interconnects only utilize a single conductor line. As the frequency of the operating AC signals rises to radio frequency (RF) levels (i.e. multi-gigahertz (GHz)), electromagnetic waves of the signals must be considered in the design to prevent signal loss along the length of the conductor. In most mobile electronics, including cell phones and wearable gadgets that use wireless communication systems, high-frequency integrated circuits are essential to perform various RF functionalities, such as microwave mixing, power amplification, low-noise amplification, and high-frequency switching.

SUMMARY

Stretchable high-frequency transmission lines and high-frequency filters comprising the transmission lines are provided.

One embodiment of a high frequency transmission line is a twisted-pair transmission line comprising a signal line entwined with a ground line, wherein the transmission line is configured to transmit a signal with microwave frequencies of 40 GHz and higher with a maximum insertion loss of −0.01 dB per μm and a minimum return loss of at least −0.01 dB per μm at a frequency of 40 GHz, a temperature of 23° C., and a characteristic impedance of 50 ohms. The signal line comprises: a first set of electrically conductive signal line segments, wherein the signal line segments in the first set are spaced apart along a first serpentine path; and a second set of electrically conductive signal line segments, wherein the signal line segments in the second set are spaced apart along a second serpentine path that has the same shape as, but is disposed above, the first serpentine path. The signal line further comprises a plurality of signal line electrical interconnects that connect the signal line segments in the first set to the signal line segments in the second set in an alternating arrangement, such that the first set of signal line segments, the second set of signal line segments and the signal line electrical interconnects form an electrically conductive signal line. The ground line comprises: a first set of electrically conductive ground line segments, wherein the ground line segments in the first set are spaced apart along the first serpentine path in an alternating arrangement with the signal line segments in the first set of signal line segments; and a second set of electrically conductive ground line segments, wherein the ground line segments in the second set are spaced apart along the second serpentine path in an alternating arrangement with the signal line segments in the second set of signal line segments. The ground line further comprises a plurality of ground line electrical interconnects that connect the ground line segments in the first set to the ground line segments in the second set in an alternating arrangement, such that the first set of ground line segments, the second set of ground line segments and the ground line electrical interconnects form an electrically conductive ground line that is entwined with the signal line. A dielectric material encapsulates the signal line and the ground line and separates the first set of signal line segments from the second set of signal line segments and also separates the first set of ground line segments from the second set of ground line segments, wherein the signal line electrical interconnects and the ground line electrical interconnects extend through the dielectric material between the first sets of signal and ground line segments and the second sets of signal and ground line segments.

One embodiment of a microwave filter comprises: a main transmission line comprising a twisted-pair transmission line in accordance with the preceding paragraph; and at least two stub lines, each joined to the side of the main transmission line and each comprising a twisted-pair transmission line in accordance with the preceding paragraph. The stub lines are configured to (that is—designed to) generate resonance at stop or pass frequencies when a microwave signal is being transmitted by the main transmission line.

Another embodiment of a high-frequency transmission line is a microscale microwave transmission line comprising: a signal line comprising a metal strip having a thickness of no greater than 2 μm, a width in the range from 5 μm to 1000 μm, and a serpentine shape along its length; a ground line comprising a metal strip having a thickness of no greater than 2 μm, a width in the range from 5 μm to 1000 μm, and the serpentine shape along its length, wherein the ground line runs parallel with the signal line; and a dielectric material encapsulating the signal line and the ground line along their lengths and separating the signal line from the ground line by a distance in the range from 0.5 μm to 5 μm. The transmission line being configured to (that is—designed to) transmit a signal with microwave frequencies of 40 GHz and higher with a maximum insertion loss of −0.01 dB per μm and a minimum return loss of −0.005 dB per μm at a frequency of 40 GHz, a temperature of 23° C., and a characteristic impedance of 50 ohms.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

FIG. 12A. Simulated (dotted) and measured (solid) scattering (S-) parameters of the transmission line with two turns of serpentine shape plotted against frequency. FIG. 12C. DC resistance values measured for signal and ground lines plotted for the four transmission lines with different numbers of turns. FIG. 12D. Measured $S_{21}$ for the four transmission lines with different number of turns plotted against frequency. FIG. 12E. Measured $S_{11}$ for the four transmission lines with different number of turns plotted against frequency. FIG. 12F. Measured $S_{21}$ for the stretchable transmission line with two turns at 0%, 20%, 25%, and 35% elongation plotted against frequency. FIG. 12G. Measured $S_{11}$ for the stretchable transmission line with two turns at 0%, 20%, 25%, and 35% elongation plotted against frequency. FIG. 12H. $S_{21}$ and $S_{11}$ at 15 GHz for different cycles of stretching to 35% elongation.

DETAILED DESCRIPTION

Figure 1A:
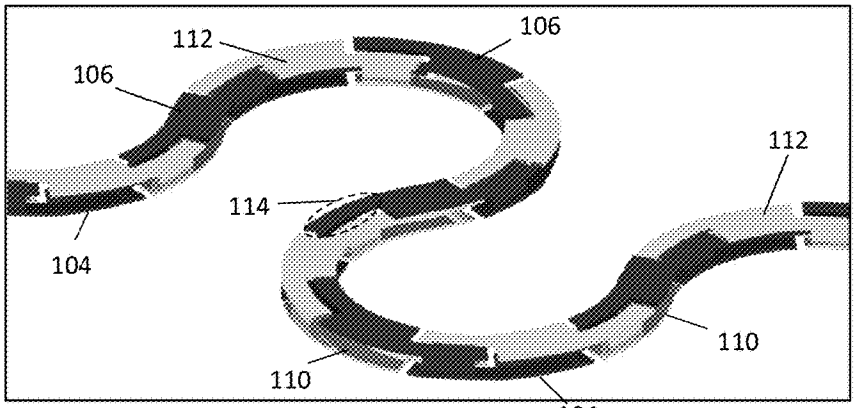
FIG. 1A. Schematic diagram of an assembled twisted-pair-based stretchable transmission line.

Stretchable high-frequency transmission lines and high-frequency filters comprising the transmission lines are provided. Also provided are methods for fabricating the transmission lines and filters. The transmission lines provide low power loss, even at microwave and millimeter wave frequencies. The transmission lines are thin and flexible and can be stretched without a significant degradation of their scattering parameters. As a result, the transmission lines have applications as interconnects in flexible or stretchable integrated circuits (IC) and circuit device components, such as flexible transistors and flexible diodes. Moreover, despite their thin construction, the transmission lines are designed to prevent signal degradation due to interference from external sources, such as the electrical properties of skin. This renders the interconnects well suited for use in EES applications.

Each transmission line comprises a signal line for propagating a signal and a ground line, both of which are electrically conductive and sufficiently thin to provide the transmission lines with mechanical flexibility. The signal and ground lines can be formed as thin films of a metal or metal alloy. Suitable metals include, but are not limited to gold, silver, copper, nickel, aluminum, titanium, chrome, gold alloys, silver alloys, and copper alloys. The signal and ground lines are encapsulated along their lengths in a dielectric material, such as a dielectric organic polymer, examples of which include polyimide, SU-8, parylene, polyurethane, polyethylene terephthalate, polydimethylsiloxane, bisphenol A, benzocyclobutene (BCB), and Ecoflex. The dielectric material serves to electrically isolate the signal and ground lines and to provide a spacing between the two lines.

The transmission lines have a serpentine shape along their lengths, which renders them highly stretchable. For the purposes of this disclosure, a transmission line is considered to have a serpentine shape if it has at least one bend that redirects the path of the transmission line. In some embodiments, the bend redirects the transmission line by at least 45°. The bend may be a sharp bend, as in the case of a zigzag shaped line, or it may be a rounded bend, as in the case of a U-shaped turn or a horseshoe turn. Some embodiments of the transmission lines have a plurality of bends along their length. For example, a transmission line may have at least two, at least three, at least five, at least ten, or an even greater number of bends. Some of the bends will redirect the path of the transmission line by at least 90° or even at least 180°, as in the case of U-shaped and horseshoe turns.

The transmission lines can be disposed on a flexible elastomeric substrate that may or may not adopt the serpentine shape of the transmission line. A variety of elastomeric materials can be used for the substrate, provided they do not interfere with the performance of the transmission line. Silicone is one example of a suitable substrate material. The transmission lines can be arranged such that the plane of the serpentine shape lies on the surface of the substrate. That is, the angle formed between the surface of the substrate and the plane of the serpentine shape is 0°. However, the plane of the serpentine shape can also run at an angle greater than 0° and up to 90° with respect to the surface of the substrate.

The transmission lines have geometries and dimensions that allow them to transmit microwave signals with very low power loss, as illustrated by the various embodiments described below.

Figure 1B:
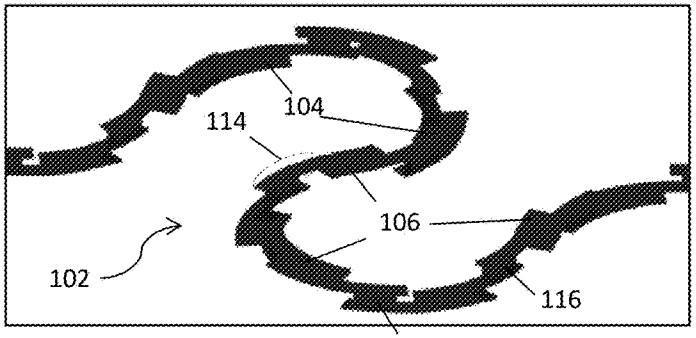
FIG. 1B. Schematic diagram of the signal line in the twisted-pair transmission line of FIG. 1A.
Figure 1C:
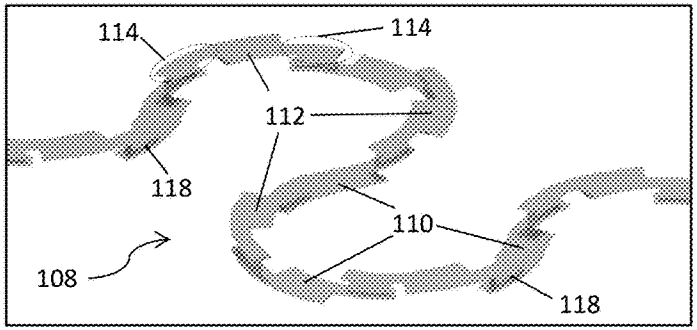
FIG. 1C. Schematic diagram of the ground line in the twisted-pair transmission line of FIG. 1A.

One embodiment of a high-frequency transmission line has a twisted pair geometry, as illustrated schematically in FIGS. 1A-1C, where FIG. 1A shows the signal and ground lines together in a twisted pair structure, FIG. 1B shows the signal line in isolation, and FIG. 1C shows the ground line in isolation. In the twisted pair transmission line both the signal line and the ground line are comprised of a series of line segments connect through vertical electrical interconnects. The signal and ground lines are entwined, such that one winds about the other in a symmetric structure, in order to cancel, or at least reduce, electromagnetic interference (EMI) from external sources, such as human skin. As best shown in FIG. 1B, signal line 102 comprises a first set of signal line segments 104 that are spaced apart along a first (in this case, lower) serpentine path and a second set of signal line segments 106 that are spaced apart along a second (in this case, upper) serpentine path that has the same shape as, but is disposed above, the first serpentine path. As best shown in FIG. 1C, ground line 108 comprises a first set of ground line segments 110 that are spaced apart along a first (in this case, lower) serpentine path and a second set of ground line segments 112 that are spaced apart along a second (in this case, upper) serpentine path that has the same shape as, but is disposed above, the first serpentine path. As shown FIG. 1A, signal line segments 104 in the first set and ground line segments 110 in the first set have an alternating arrangement along the first serpentine path and signal line segments 106 in the second set and ground line segments 112 in the second set have an alternating arrangement along the second serpentine path. In this construction, each signal line segment 104 in the first (lower) set is disposed opposite a ground line segment 112 in the second (upper) set and each ground line segment 110 in the first (lower) set is disposed opposite a signal line segment 106 in the second (upper) set.

The signal and ground line segments, which are thin layers or films of an electrically conductive material, typically have a thickness of no greater than about 20 μm. This includes embodiments in which the signal and ground line segments have a thickness of not greater than 5 μm and further includes embodiments in which the signal and ground lines segments have a thickness of not greater than 2 μm. For example, some embodiments of the line segments have thicknesses in the range from 100 nm to 2 μm. This includes embodiments of the line segments having thicknesses in the range from 400 nm to 1.5 μm and further includes line segments having thicknesses in the range from 800 nm to 1.1 μm. The lengths of the line segments can vary depending on the degree of curvature of the bends along the serpentine paths and/or on the desired degree of transmission line stretchability. Typically, the lengths of the line segments will be no greater than 500 μm and, more typically, no greater than 200 μm. The widths of the line segments are also desirably sized to provide superior lossless transmission with the balance of enhancing the stretchability of the lines. Typically, the width of the signal and ground line segments, measured as the longest lateral distance between the furthest outside edges of a line segment, is no greater than 300 μm. This includes line segments having widths of no greater than 100 μm and further includes line segments having widths of no greater than 50 μm (for example, between 10 μm and 300 μm). However, it is possible to make the transmission lines much wider, with widths of up to 10 mm or greater, including widths in the range from 2 mm to 10 mm.

The signal and ground line segments each comprise at least one longitudinal extension (also referred to as a "digit" or "finger") and, generally includes at least one longitudinal extension at opposite ends of the line segment. As used here, a longitudinal extension refers to an elongated section of the line segment that has section width (w) that is smaller than the width of the line segment (W), where W is the longest lateral distance between the furthest outside edges of a line segment. Thus, the signal and ground line segments in the transmission line in FIGS. 1A-1C each have one extension 114 at their opposing ends. The extension(s) on each line segment have a shape that compliments and conforms to the shape of the extension(s) on its neighboring segment(s), such that the alternating signal line segments and ground line segments are interdigitated along the serpentine paths. In this construction, the extension of a signal line segment in the second (upper) set will be separated from, but overhang, the extension of a signal line segment in the first (lower) set and, similarly, the extension of a ground line segment in the second (upper) set will be separated from, but overhang, the extension of a ground line segment in the first (lower) set. The overhanging extensions of the signal line segments are connected by a series of electrically conducting vertical signal line interconnects 116 to complete the signal line. Likewise, the overhanging extensions of the ground line segments are connected by a series of electrically conducting vertical ground line interconnects 118 to complete the ground line. The cross-sectional areas of the interconnects (or "vias") should be large enough to assure good electrical conductivity along the transmission lines. By way of illustration only, the interconnects can have cross-sectional areas in the range from 5 $\mu m^2$ to 500 $\mu m^2$.

Figure 2A:
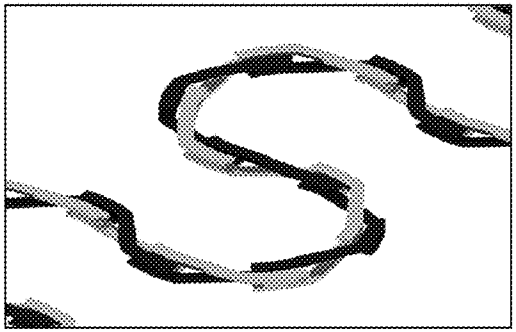
FIG. 2A. Schematic diagram of a first embodiment of a twisted-pair transmission line without interdigitated signal and ground line segments.
Figure 2B:
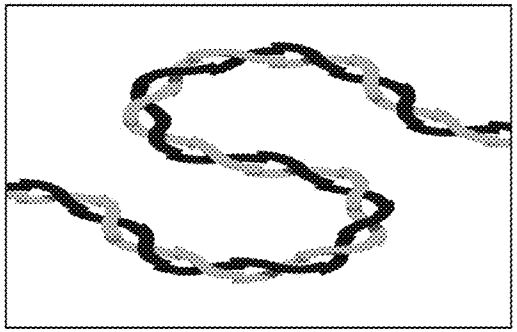
FIG. 2B. Schematic diagram of a second embodiment of a twisted-pair transmission line without interdigitated signal and ground line segments.
Figure 2C:
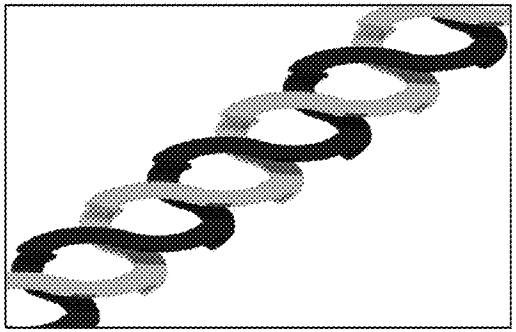
FIG. 2C. Schematic diagram of a third embodiment of a twisted-pair transmission line without interdigitated signal and ground line segments.

FIGS. 1A-1C depict one possible shape for the signal and ground line segments. However, other shapes can be used. Examples of some other shapes are shown in FIGS. 2A, 2B and 2C.

Both the signal line and the ground line are encased along their lengths by a dielectric polymer material through which the electrical interconnects extend. This dielectric polymer material isolates the signal line from the ground line and provides a vertical spacing between the signal and ground line segments in the first (upper) sets of segments and the signal and ground line segments in the second (lower) sets of segments. Typically, the vertical inter-segment spacing is in the range from 3 μm to 8 μm and, in some embodiments, is in the range from 4 μm to 6 μm.

Methods of making the twisted pair transmission lines are illustrated in Example 1. Briefly, the methods comprise the steps of: forming a first layer of a dielectric polymer material on a sacrificial substrate; forming a first set of signal line segments and a first set of ground line segments on the first layer of dielectric material, wherein the signal line segments of the first set and the ground line segments of the first set are formed in a spatially separated, alternating, and interdigitated arrangement along a first serpentine path; forming a second layer of a dielectric material over the first set of signal line segments and the first set of ground line segments; forming vertical electrical interconnects through the second layer of dielectric material, such that each signal line segment and each ground line segment in the first set is connected across two vertical interconnects; forming a second set of signal line segments and a second set of ground line segments on the second layer of material, wherein the signal line segments of the second set and the ground line segments of the second set are formed in an spatially separated, alternating, and interdigitated arrangement along a second serpentine path, wherein the second serpentine path has the same shape as, but is disposed above, the first serpentine path, and further wherein each signal line segment and each ground line segment in the second set is connected across two of the vertical electrical interconnects;

and forming a third layer of dielectric material over the second set of signal line segment and the second set of ground line segments. The layers of dielectric material encasing the signal and ground lines can then be cut (e.g., etched) to conform to the serpentine shape define by the signal and ground lines and the sacrificial substrate can be selectively removed (e.g., etched away) to release the twisted pair transmission line. The released twisted pair transmission line can then be transferred onto another support substrate, which may be an elastomeric support substrate.

Although the signal and ground line segments in the twisted pair transmission line shown in FIGS. 1A-1C comprise digits and are interdigitated, that is not a requirement. FIGS. 2A, 2B, and 2C are schematic diagrams of twisted pair transmission lines in which the signal and ground line segments are not interdigitated.

Figure 3A:
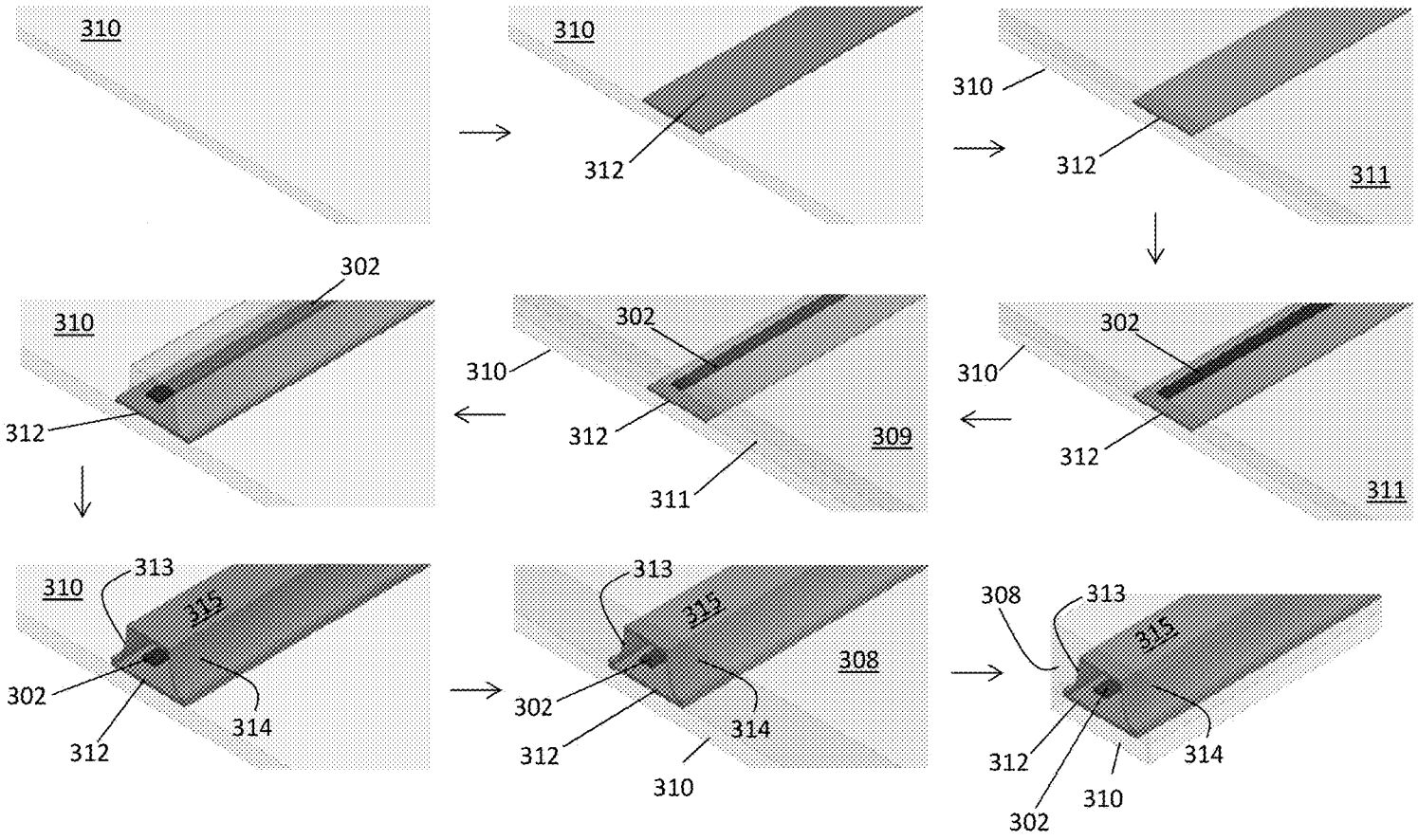
FIG. 3A. Schematic diagram showing the steps for fabricating a microcoaxial transmission line.

Another embodiment of a high-frequency transmission line has a microcoaxial-like geometry, as illustrated schematically in FIG. 3A (panel i). In this type of transmission line a signal line 302 is encased along its length by a dielectric material, which is sheathed in an electrically conductive film that provides a shielding ground line in the form of a conduit that comprises a bottom ground strip 312, a first side wall 313, a second, opposing side wall 314, and a top strip 315. Signal line 302 and ground line are aligned coaxially and separated by the dielectric material. An outer layer of elastomeric dielectric material 308, 310 encapsulates the ground line along its length to complete the transmission line. The transmission line has a serpentine shape along its length in order to render it stretchable. Optionally, the transmission line may further include a support substrate that may be elastomeric.

Signal line 302 is a thin conductive strip of electrically conductive material, typically having a thickness of no greater than about 20 μm. In some embodiments, the conductive signal line strip has a thickness of no greater than 5 μm. This includes embodiments in which the signal line strip has a thickness of not greater than 2 μm. For example, some embodiments of the conductive strips have thicknesses in the range from 0.1 μm to 2 μm. This includes embodiments of the conductive strips having thicknesses in the range from 0.8 μm to 1.2 μm and further includes conductive strips having thicknesses in the range from 0.9 μm to 1.1 μm. The widths of the conductive strips are sized to provide superior lossless transmission and to enhance the stretchability of the lines. Typically, the width of the conductive strip is no greater than 20 μm. This includes strips having widths of no greater that 10 μm and further includes strips having widths of no greater that 5 μm (for example, between 2 μm and 4 μm or between 7 μm and 11 μm). However, it is possible to make the transmission lines much wider, with widths of up to 10 mm or greater, including widths in the range from 2 mm to 10 mm. Typically, the radial spacing between the signal line and the ground line, that is—the distance from the signal line to the inner surface of the ground line conduit—is in the range from 4 μm to 8 μm and, in some embodiments, is in the range from 4 μm to 6 μm. The ground line is also a thin film of electrically conductive material, typically having a thickness of no greater than 2 μm.

Figure 3B:
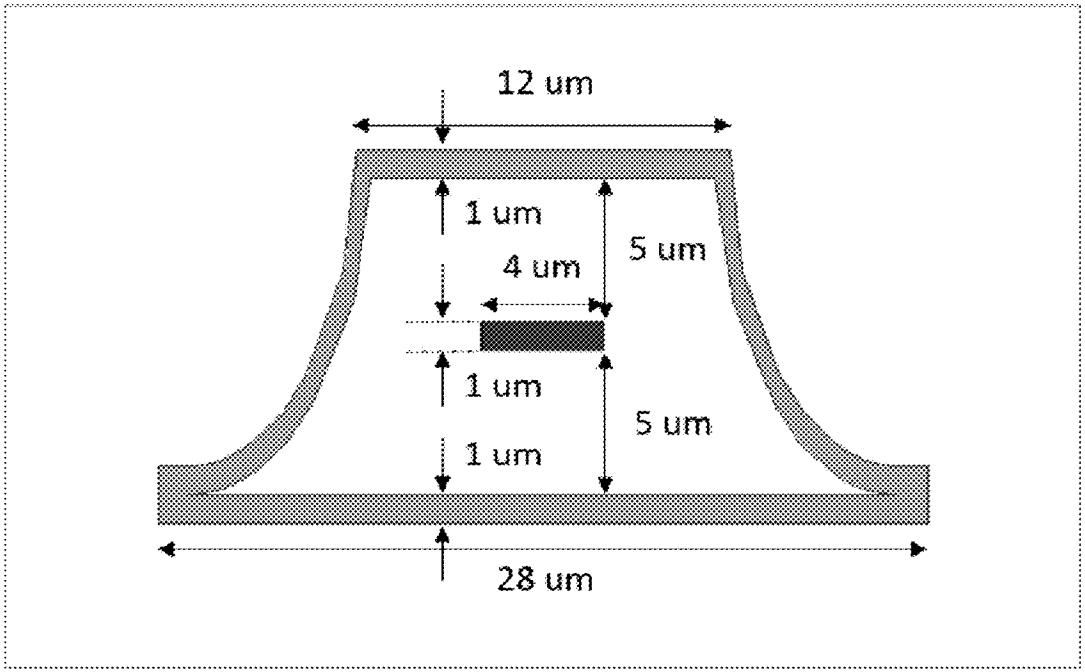
FIG. 3B. Schematic diagram showing a cross-sectional view of the microcoaxial transmission line of FIG. 3A.

Methods of making the microcoaxial transmission lines are illustrated in Example 1. Briefly, as shown in FIG. 3A, the methods comprise the steps of: forming a first layer of an dielectric polymer material 310 on a sacrificial substrate (not shown)(panel a); forming a bottom ground strip 312 in a serpentine shape on the first layer of dielectric material (panel b); forming a second layer of a dielectric material 311 over the over bottom ground strip 312 (panel c); forming a signal line 302 comprising an electrically conductive strip in the serpentine shape on the second layer of dielectric material 311 (panel d), wherein signal line 302 has the same shape as and runs parallel with bottom ground strip 312, but is disposed above and is narrower than the bottom ground strip; and forming a third layer of dielectric material 309 over signal line 302, such that the signal line is sandwiched between the second and third layers of dielectric material 311, 309 (panel e). Portions of the second and third layers of dielectric material 311, 309 can then be removed (e.g., etched) to expose the side edges of the upper surface of bottom ground strip 312 and to provide a strip of dielectric material that encases the signal line along its length and conforms to the serpentine shape of the signal line (panel f). A layer of electrically conductive material is then deposited onto the side and top surfaces of this strip, and onto the exposed portions of the upper surface of bottom ground strip 312 to form the side walls 313, 314 and the top strip 315 of the ground line conduit (panel g). A fourth layer of dielectric material 308 is formed over top strip 315 and side walls 313, 314 of the ground line (panel h), such that the underlying first layer of dielectric material 310 and the overlying fourth layer of dielectric material 308 encase the ground line conduit along its length. The first and fourth layers of dielectric material can then be cut (e.g., etched) so that they conform to the serpentine shape define by the signal and ground lines (panel i) and the sacrificial substrate (not shown) can be selectively removed (e.g., etched away) to release the transmission line. The released transmission line can then be transferred onto another support substrate, which may be an elastomeric support substrate. A cross-sectional view of the finished transmission line is shown in FIG. 3B.

Figure 4:
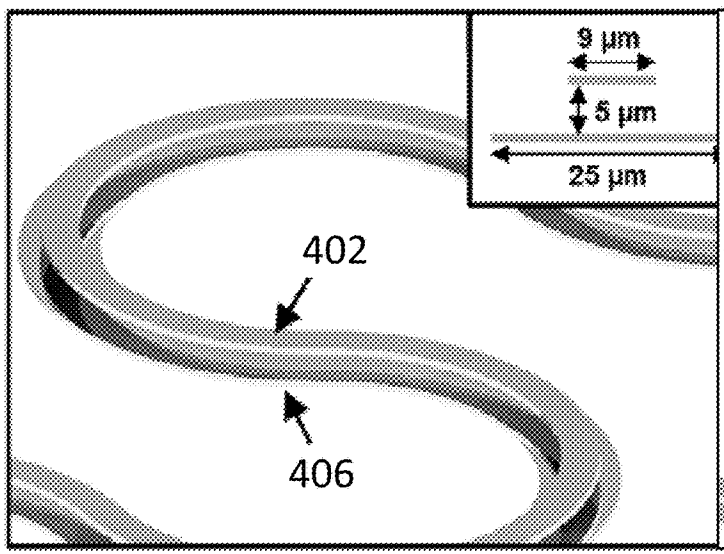
FIG. 4. Schematic diagram of the ground line and signal line in a microstrip transmission line.

Another embodiment of a high-frequency transmission line has a microstrip geometry, as illustrated schematically in FIG. 4. This geometry is similar to the microcoaxial geometry, but the ground line comprises only bottom ground strip without the top strip or side walls. Thus, the microstrip transmission line comprises; a signal line 402 and an underlying ground line 406. The signal line and the ground line run parallel to one another and have the same serpentine shape, but the signal line is narrower than the ground line. The signal and ground lines are encased along their lengths and vertically spaced apart from one another by dielectric material. Optionally, the transmission line may further include a support substrate that may be elastomeric.

Signal line 402 is a thin conductive strip of electrically conductive material, typically having a thickness of no greater than about 20 μm. In some embodiments, the conductive signal line strip has a thickness of no greater than 5 μm. This includes embodiments in which the signal line strip has a thickness of not greater than 1.5 μm. For example, some embodiments of the conductive strips have thicknesses in the range from 0.5 μm to 1.5 μm. This includes embodiments of the conductive strips having thicknesses in the range from 0.8 μm to 1.2 μm and further includes conductive strips having thicknesses in the range from 0.9 μm to 1.1 μm. The ground line is also a thin conductive strip of electrically conductive material and may have a thickness in the same ranges as those cited above for the signal line. The widths of the conductive strips are also desirably very thin to provide superior lossless transmission and to enhance the stretchability of the lines. Typically, the width of the conductive strip of the signal line is no greater than 20 μm. This includes signal line strips having widths of no greater that 15 μm and further includes signal line strips having widths of no greater than 10 μm (for example, between 5 μm and 15 μm or between 7 μm and 11 μm). The conductive strip of the ground line is wider than the conductive strip of the signal line. In some embodiments, the ground line strip has a width no greater than 100 μm. This includes embodiments in which the width of the ground line strip is no greater than 50 μm. However, it is possible to make the signal and ground line strips much wider, with widths of up to 10 mm or greater, including widths in the range from 2 mm to 10 mm. Typically, the spacing between the signal line and the ground line, that is—the distance from the upper surface of the ground line conductive strip to the lower surface of the signal line conductive strip—is in the range from 1 μm to 8 μm and, in some embodiments, is in the range from 4 μm to 6 μm.

Methods of making the microstrip transmission lines are illustrated in Example 1. Briefly, the methods comprise the steps of: forming a first layer of a dielectric material on a sacrificial substrate; forming a ground line comprising an electrically conductive strip in a serpentine shape on the first layer of dielectric material; forming a second layer of an dielectric material over the ground line, such that the ground line is sandwiched between the first and second layers of dielectric material; forming a signal line comprising an electrically conductive strip in the serpentine shape on the second layer of dielectric material, wherein the signal line has the same shape as and runs parallel with the ground line, but is disposed above and is narrower than the ground line; and forming a third layer of dielectric material over the signal line, such that the signal line is sandwiched between the second and third layers of dielectric material. Portions of the first, second, and third layers of dielectric material can then be removed (e.g., etched) to provide a strip of dielectric material that encases the signal line and the ground line along their lengths and conforms to their serpentine shape. The sacrificial substrate then can be selectively removed (e.g., etched away) to release the transmission line. The released transmission line can then be transferred onto another support substrate, which may be an elastomeric support substrate.

Figure 5:
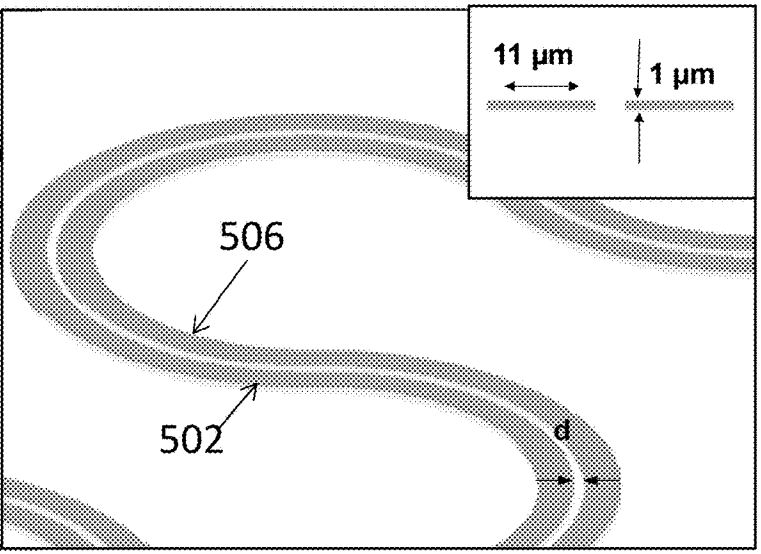
FIG. 5. Schematic diagram of the ground line and signal line is a quasi-coplanar strip transmission line.

Another embodiment of a high-frequency transmission line has a quasi-coplanar strip geometry, as illustrated schematically in FIG. 5. This quasi-coplanar strip transmission line comprises; a signal line 502 having a serpentine shape and a ground line 506 having the same serpentine shape and running parallel to signal line 502. Although the left hand strip is labeled as the signal line and the right hand strip the ground line in FIG. 5, either of the lines can be the signal line and the other the ground line. Signal line 502 and ground line 506 are spaced apart laterally and encased along their lengths by an elastomeric dielectric material (not shown). Optionally, the transmission line may further include a support substrate that may be elastomeric.

Signal line 502 and ground line 506 are thin conductive strips of electrically conductive material, typically having a thickness of no greater than about 20 μm. In some embodiments, the conductive strips of the signal and ground lines have a thickness of no greater than 5 μm. This includes embodiments in which the signal line strip has a thickness of not greater than 3 μm. For example, some embodiments of the conductive strips have thicknesses in the range from 0.5 μm to 1.5 μm. This includes embodiments of the conductive strips having thicknesses in the range from 0.8 μm to 1.2 μm and further includes conductive strips having thicknesses in the range from 0.9 μm to 1.1 μm. The widths of the conductive strips are also desirably very thin to provide superior lossless transmission and to enhance the stretchability of the lines. Typically, the widths of the conductive strips of the signal and ground lines are no greater than 20 μm. This includes conductive strips having widths of no greater than 200 μm and further includes signal line strips having widths of no greater than 50 μm (for example, between 5 μm and 15 μm or between 10 μm and 25 μm). However, it is possible to make the conductive strips much wider, with widths of up to 10 mm or greater, including widths in the range from 2 mm to 10 mm. Typically, the spacing between the signal line and the ground line, that is—the distance from the inner most edge of the ground line conductive strip to the inner most edge of the signal line conductive strip—is no greater than 2 μm and, in some embodiments is no greater than 1.5 μm. By way of illustration, in some embodiments of the quasi-coplanar strip transmission lines, the lateral spacing between the conductive strip of the signal line and the conductive strip of the ground line is in the range from 0.5 μm to 2 μm and, in some embodiments, is in the range from 0.5 μm to 1.5 μm.

Methods of making the quasi-coplanar strip transmission lines are illustrated in Example 1. Briefly, the methods comprise the steps of: forming a first layer of a dielectric material on a sacrificial substrate; forming a ground line comprising an electrically conductive strip in a serpentine shape on the first layer of dielectric material; forming a signal line comprising an electrically conductive strip in the serpentine shape on the first layer of dielectric material, wherein the signal line has the same shape as and runs parallel with the ground line, but is laterally spaced apart from the ground line; forming a second layer of a dielectric material over the over the ground line and the signal line, such that the ground line and the signal line are sandwiched between the first and second layers of dielectric material and the dielectric material laterally separates the ground line from the signal line. Portions of the first and second layers of dielectric material can then be removed (e.g., etched) to provide a strip of dielectric material that encases the signal line and the ground line along their lengths and conforms to their serpentine shape. The sacrificial substrate then can be selectively removed (e.g., etched away) to release the transmission line. The released transmission line can then be transferred onto another support substrate, which may be an elastomeric support substrate.

The high-frequency transmission lines are able to transmit high-frequency signals with low power loss, as reflected by their scattering parameters (S-parameters). As a result, the transmission lines can operate effectively in the EHF regime, transmitting signals with frequencies of 30 GHz or higher, including frequencies of 40 GHz and 50 GHz, or higher. For example, the transmission lines can be used to transmit signals with frequencies in the range from 30 GHz to 100 GHz, or even higher. The superior lossless characteristics of the transmission lines can be characterized by their S-parameters. In particular the transmission lines provide a low insertion loss and a high reflection loss. Insertion loss is the loss of power that results from an inserted device; return loss is the loss of power in the signal returned or reflected. To create near-lossless transmission lines, lower insertion loss and higher return loss, in terms of magnitude are desired. Insertion loss is denoted $S_{21}$ and is expressed in terms of its magnitude by 20 $\log|S_{21}|$ in units of dB, and return loss is denoted $S_{11}$ and is expressed in terms of its magnitude by 20 $\log|S_{11}|$ in units of dB. Because they represent a 'loss', they are denoted with negative values. Unless otherwise indicated, the values for the insertion loss and return loss recited herein refer to the loss values in terms of magnitude at 23° C. when 50 ohms is used as the characteristic (i.e., reference)

impedance. S-parameters for a transmission line can be obtained from the radiofrequency (RF) characteristics of the transmission line, as described in detail in the Examples below.

The S-parameters can be recited as the total insertion loss or reflection loss for a given transmission line or as the loss per unit of length. The maximum acceptable insertion loss will depend on the particular application for which the transmission line is intended to be used. However, for many applications a maximum insertion loss of −5 dB is acceptable. For clarification, as used herein, the phrase "maximum insertion loss of −5 dB", refers to an insertion loss with a value that lies in the range from 0 dB to −5 dB. Embodiments of the present transmission lines provide a maximum insertion loss of −5 dB for transmission line lengths of up to 5000 μm, or longer. For example, some embodiments of the transmission lines provide a maximum insertion loss of −5 dB at 40 GHz for transmission line lengths in the range from 500 μm to 4000 μm, including transmission line lengths in the range from 500 μm to 1000 μm, where the length of the transmission lines is measured along its serpentine shape. As illustrated in Example 1, embodiments of the transmission lines having lengths in these ranges are also able to provide a maximum insertion loss of −5 dB at 40 GHz. This includes embodiments of the transmission lines that are able to provide a maximum insertion loss of −3 dB at 40 GHz, and further includes transmission lines that are able to provide a maximum insertion loss of −2 dB at 40 GHz. For longer transmission lines, the maximum insertion loss can be recited per unit of length. For some embodiments of the transmission lines, the maximum insertion loss per unit length at 40 GHz is −0.0030 dB/μm. This includes embodiments of the transmission lines having a maximum insertion loss per unit length of −0.0025 dB/μm at 40 GHz, further includes embodiments of the transmission lines having a maximum insertion loss per unit length of −0.0015 dB/μm at 40 GHz, and still further includes embodiments of the transmission lines having a maximum insertion loss per unit length of −0.0012 dB/μm at 40 GHz.

The minimum acceptable return loss will also depend on the particular application for which the transmission line is intended to be used. However, for many applications a minimum return loss of −10 dB is acceptable. For clarification, as used herein, the phrase "a minimum return loss of −10 dB" refers to a return loss with an absolute value of at least 10 dB, although the actual value will be negative to reflect the fact that it represents a loss. Embodiments of the present transmission lines provide a minimum return loss of −10 dB for transmission line lengths of up to 5000 μm, or longer. For example, some embodiments of the transmission lines provide a minimum return loss of −10 dB at 40 GHz for transmission line lengths in the range from 500 μm to 4000 μm, including transmission line lengths in the range from 500 μm to 1000 μm, where the length of the transmission lines is measured along its serpentine shape. As illustrated in Example 1, embodiments of the transmission lines having lengths in these ranges are also able to provide a minimum return loss of −15 dB at 40 GHz. For longer transmission lines, the minimum return loss can be recited per unit of length. For some embodiments of the transmission lines, the minimum return loss per unit length at 40 GHz is −0.010 dB/μm. This includes embodiments of the transmission lines having a minimum return loss per unit length of −0.013 dB/μm at 40 GHz, further includes embodiments of the transmission lines having a minimum return loss per unit length of −0.020 dB/μm at 40 GHz, and still further includes embodiments of the transmission lines having a minimum return loss per unit length of −0.025 dB/μm at 40 GHz.

The serpentine shape of the transmission lines allows them to be stretched along their lengths without sacrificing their performance. By way of illustration, in some embodiments of the transmission lines, the insertion loss and return loss values are changed by no more than 15% when the transmission line is stretched to 20% (i.e., its end-to-end length is increased by 20% relative to its unstretched state, as illustrated in Example 1). In some embodiments the insertion loss and return loss values are changed by no more than 10% or no more than 5% when the transmission line is stretched to 20%. For at least some embodiments of the transmission lines, these low changes in the S-parameters are observed even when the transmission lines are stretched to 35%, including embodiments in which these low changes in the S-parameters are observed even when the transmission lines are stretched to 100% or 200%. Notably, the performance of the transmission lines remains high even after repeated stretch cycles. For example, as illustrated in Example 1, embodiments of the transmission lines can undergo at least 100 stretch and release cycles at a stretch of 35% without a noticeable decrease in performance.

The microwave transmission lines can be used to make microwave stub filters by joining short lengths of the transmission lines along the length of a main microwave transmission line. In these microwave filters, the main transmission line may also be a microwave transmission line, of the type described herein. The lengths and widths of the stubs can be selected to generate resonance at stop or pass frequencies to provide low-pass or band-stop microwave filters. For example, the stubs can be wider than and shorter (or longer) than the main transmission line. This is illustrated in Example 1 for a main twisted pair transmission line having a plurality of twisted pair stubs forming junctions along its sides.

EXAMPLES

Example 1: Twisted-Pair, Microstrip, and Coplanar-Strip Transmission Lines

This example illustrates the design and fabrication of high-frequency transmission lines with low RF and radiation losses for EES. Because high-frequency signals also carry electromagnetic waves with short wavelengths, transmission lines that use two conductors, where one is considered a ground become necessary.

The interconnects have superior lossless characteristics at EHF and are sufficiently small (e.g., 25 μm in line width) to be integrated with active components, such as high-frequency flexible transistors and diodes.

Figures 6A, 6B, 6C, 6D, 6E, 6F:
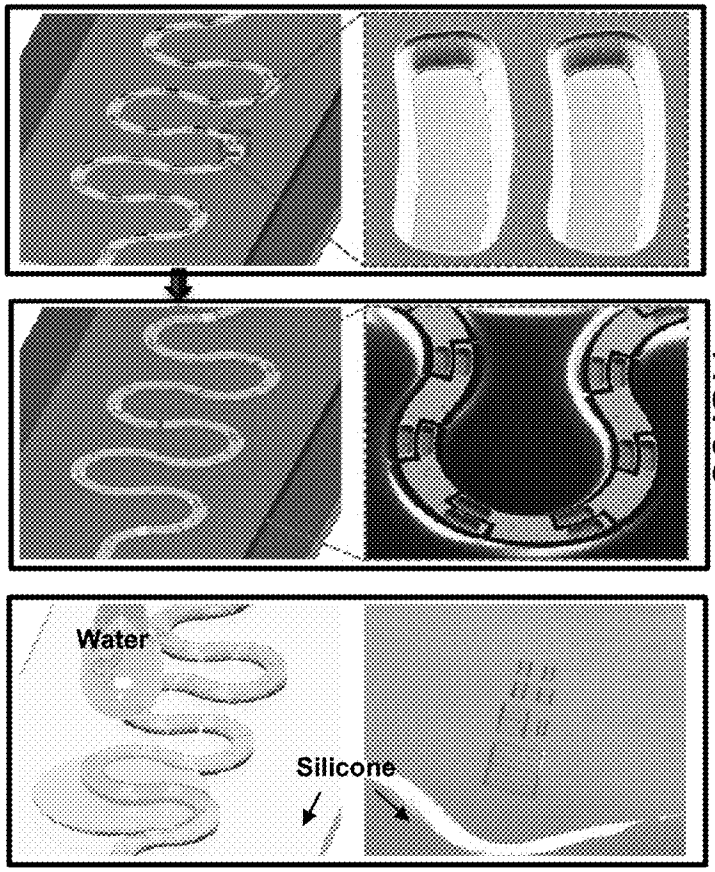
FIG. 6A. Optical microscopy image (left panel) and three dimensional (3D)-rendered illustration image (right panel) of a first set of alternating and interdigitated gold ground line segments and gold signal line segments, with fingers on their opposing ends, deposited in a serpentine path on a first layer of polyimide coated on a silicon substrate.
FIG. 6B. 3D-rendered illustration image (left panel) and false colored scanning electron microscope image (right panel) of the alternating and interdigitated gold ground line segments and gold signal line segment after being coated by a second layer of polyimide and having via-holes, with 60° sidewall slopes, etched into their fingers.
FIG. 6C. 3D-rendered illustration image (left panel) and false colored scanning electron microscope image (right panel) of a second set of alternating and interdigitated gold ground line segments and gold signal line segments, with fingers on the opposite side with respect to those in the first set, deposited in a serpentine path on the second layer of polyimide.
FIG. 6D. Optical microscopy image (left panel) and 3D-rendered illustration image (right panel) of the second set of alternating and interdigitated gold ground line segments and gold signal line segments of FIG. 6C after encapsulation with a third layer polyimide and etching into a serpentine shape.
FIG. 6E. Photograph image (left panel) and 3D-rendered illustration image (right panel) of the twisted-pair transmission line delaminated from the silicon substrate.
FIG. 6F. 3D-rendered illustration image (left panel) and photograph image (right panel) of the twisted-pair transmission line transfer printed onto a silicone elastomer substrate.
Figure 6G:
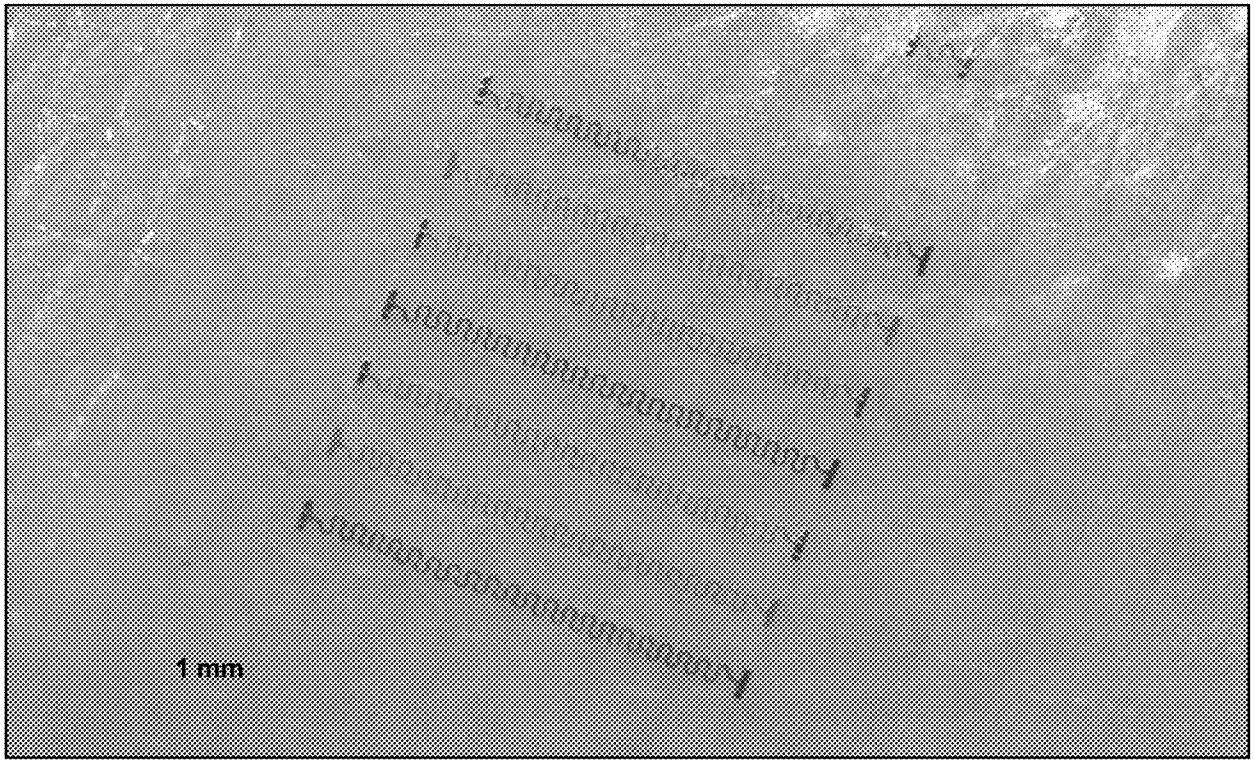
FIG. 6G. Photograph image of a stretchable twisted-pair transmission line array laminated on the back of a hand.

In FIG. 6A, a type of wearable stretchable transmission line that can operate at EHF with extremely low levels of power loss by integrating a balanced twisted-pair geometry into a "horseshoe" shaped serpentine structure is presented. The balanced pair cancels out electromagnetic interference (EMI) from external sources. The twisted-pair geometry for the signal and ground lines is integrated into a thin-film format by utilizing two-segmented sets of metal blocks (the signal and ground line segments) in dual layer construct, crisscrossing each other with multiple via-holes as shown in FIGS. 1A-1C. FIGS. 6A-6F show 3D-rendered illustration, scanning electron microscopy (SEM) and optical microscopy (OM) images, of the fabrication process for a twisted-pair-based stretchable transmission line. On a polyimide-coated Si substrate, multiple blocks ("line segments") of metal (Au) with fingers ("extensions") on each side were deposited along a serpentine path (FIG. 6A), followed by opening polyimide-based via-holes on all the fingers (FIG. 6B). Slanted side walls of the via-holes were created by isotropic etching to ensure perfect connection between the line segments in the two layers and to minimize electrical resistance. Another layer of metal line segments, with fingers on opposite sides with respect to the line segments in the first layer, was deposited to create a twisted-pair geometry (FIG. 6C). The transmission line was defined by etching the structures into serpentine shapes (FIG. 6D) and the resulting serpentine structure was delaminated from the Si substrate using water-soluble cellulose tape (FIG. 6E), followed by transfer printing the delaminated transmission line onto a modified silicone (Ecoflex) substrate and dissolving the tape with water (FIG. 6F). The stretchable twisted-pair transmission line was designed to have characteristic impedance of 50 ohms for compatible integration with other RF components. Polyimide was used as the encapsulating dielectric spacer material due to its mechanical stability and favorable RF characteristics, featuring a low RF loss tangent (tan $\delta$=0.006) with a dielectric constant of 3. Furthermore, modified silicone (Ecoflex) was used as the substrate, which is a suitable biocompatible elastomer for many EESs, as it can be cast in ultrathin sheets and can conformally attach to the skin. It is also a suitable elastomer for RF electronics as it features a relatively low RF loss tangent (tan $\delta$=0.01) with a dielectric constant of 2.5. FIG. 6G shows an image of a stretchable transmission line array laminated on the back of a hand. The transmission lines can withstand the strain and stress due to the deformations of the skin.

Figure 7A:
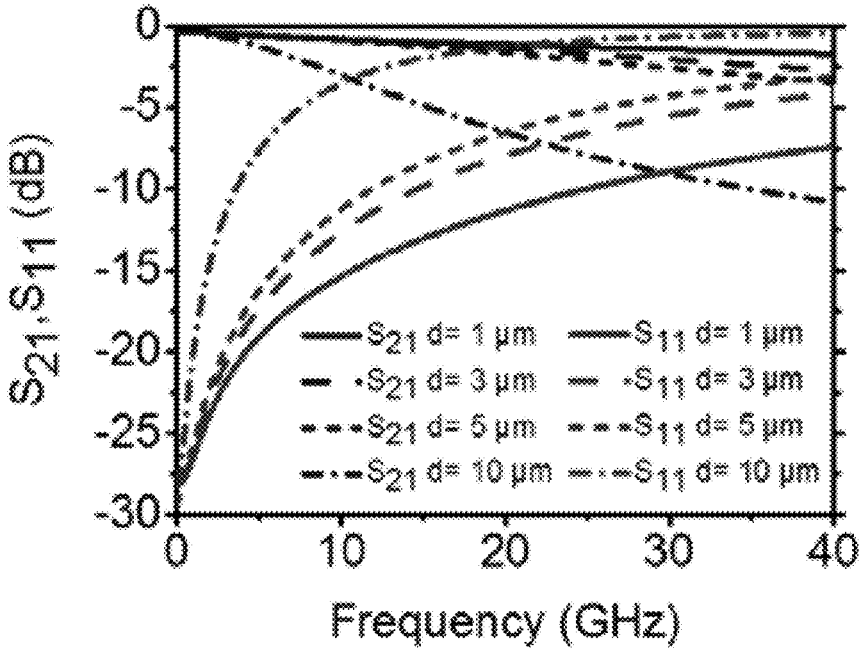
FIG. 7A. Simulated high-frequency S-parameters for a quasi-coplanar line transmission line, simulated with a ground line and signal line separation distances of 1, 3, 5, and 10 μm.
Figure 7B:
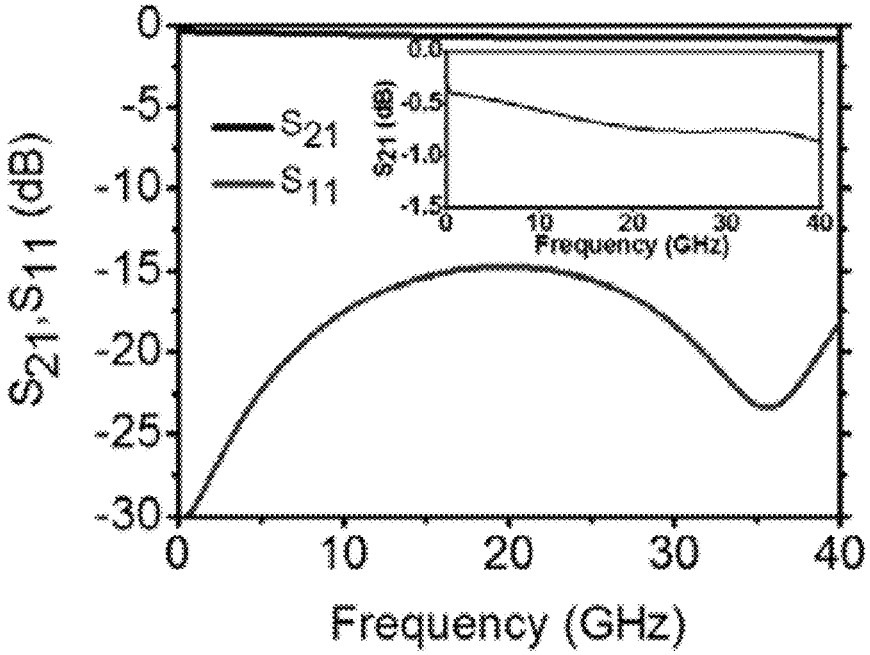
FIG. 7B. Simulated high-frequency S-parameters for a microstrip transmission line.
Figure 7C:
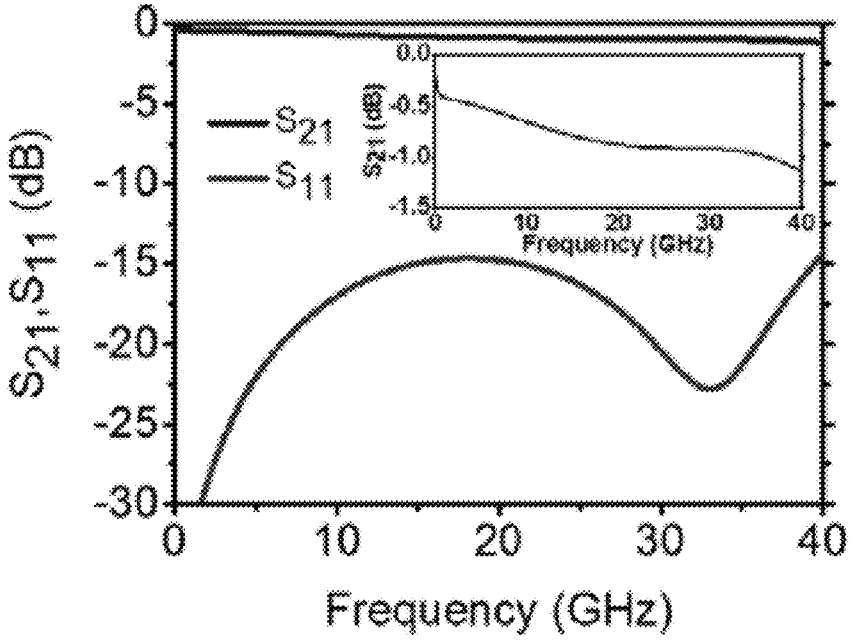
FIG. 7C. Simulated high-frequency S-parameters for a twisted-pair transmission line.
Figure 8A:
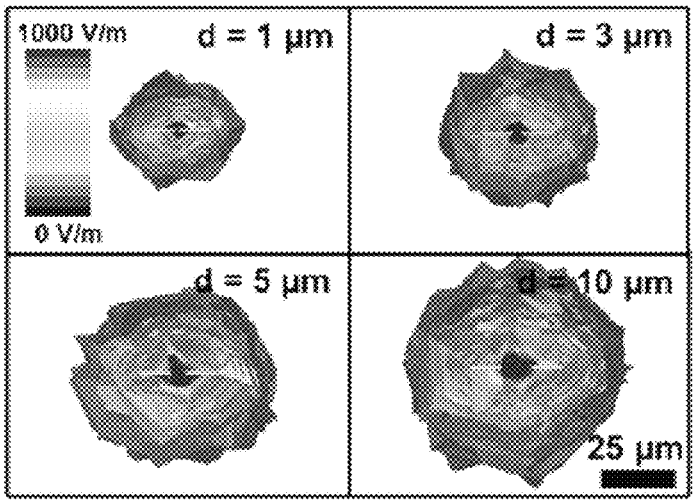
FIG. 8A. Radiation confinement calculations showing electric field distribution at 40 GHz for a quasi-coplanar line transmission line simulated with ground line and signal line separation distances of 1, 3, 5, and 10 μm.
Figure 8B:
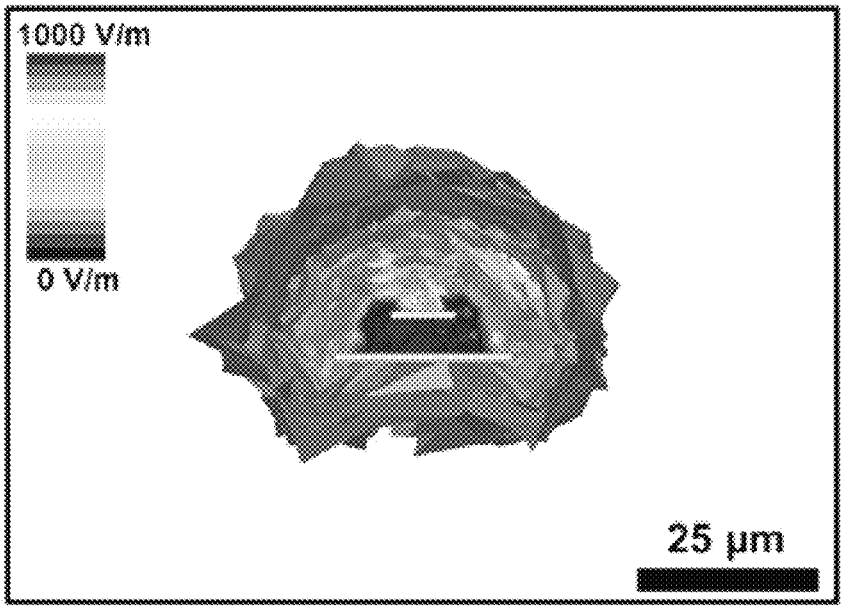
FIG. 8B. Radiation confinement calculations showing electric field distribution at 40 GHz for a microstrip transmission line.
Figure 8C:
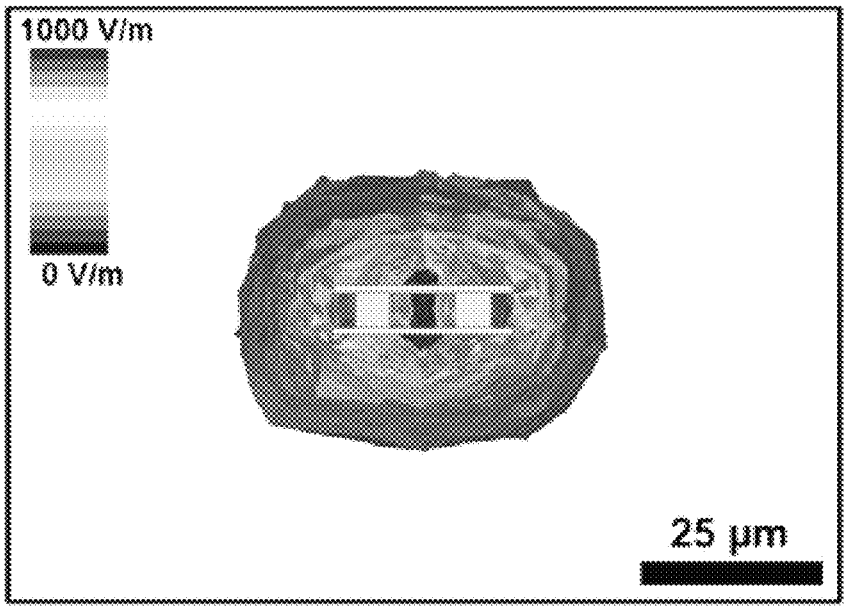
FIG. 8C. Radiation confinement calculations showing electric field distribution at 40 GHz for a twisted-pair transmission line.
Figure 9A:
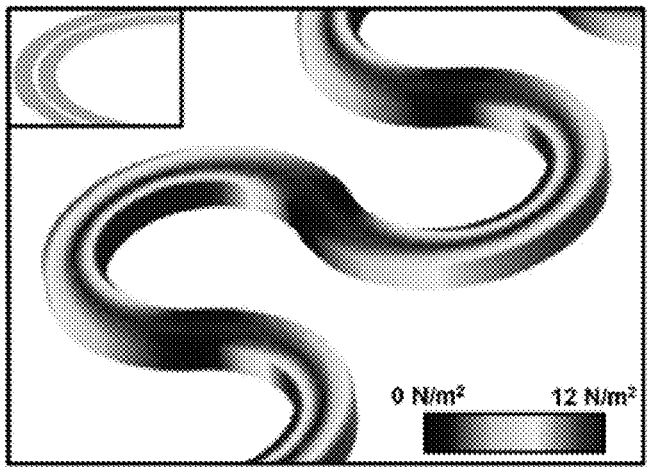
FIG. 9A. Finite element analysis showing equivalent von Mises stress distribution in the serpentine structures with 1 N of tensile force applied on a quasi-coplanar line (d=3 μm) transmission line. Inset image shows the metal strips embedded in polyimide.
Figure 9B:
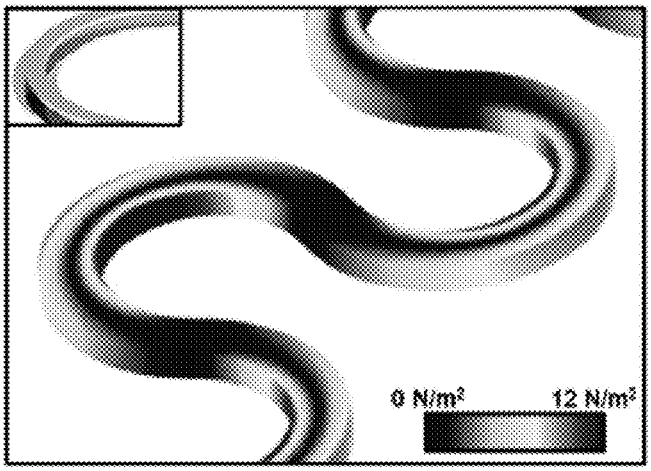
FIG. 9B. Finite element analysis showing equivalent von Mises stress distribution in the serpentine structures with 1 N of tensile force applied on a microstrip transmission line. Inset image shows the metal strips embedded in polyimide.
Figure 9C:
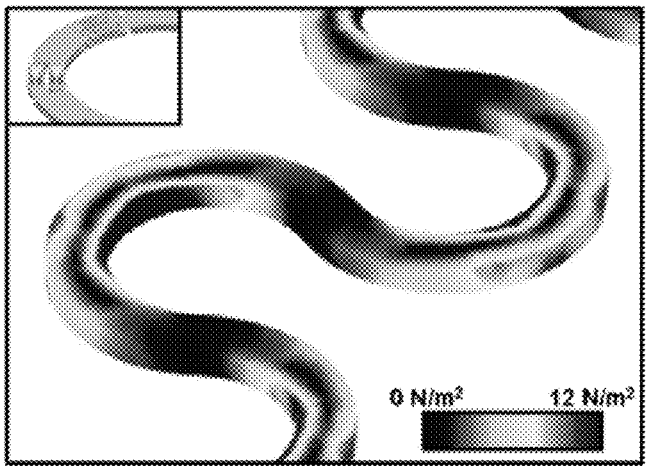
FIG. 9C. Finite element analysis showing equivalent von Mises stress distribution in the serpentine structures with 1 N of tensile force applied on a twisted-pair transmission line. Inset image shows the metal strips embedded in polyimide.
Figure 10A:
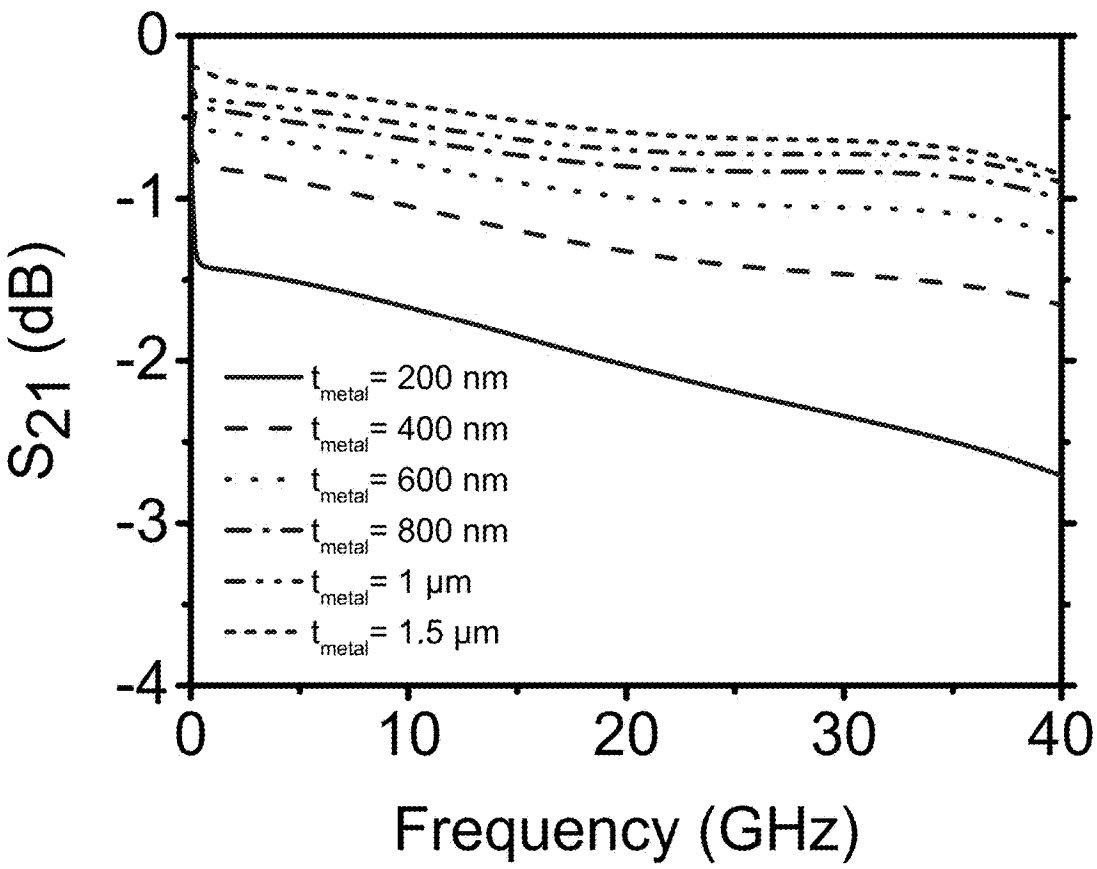
FIG. 10A. Simulated $S_{21}$ against frequency for signal thickness variations for a stretchable microstrip transmission line. Losses are enhanced with increasing thickness and saturate at 1 μm.
Figure 10B:
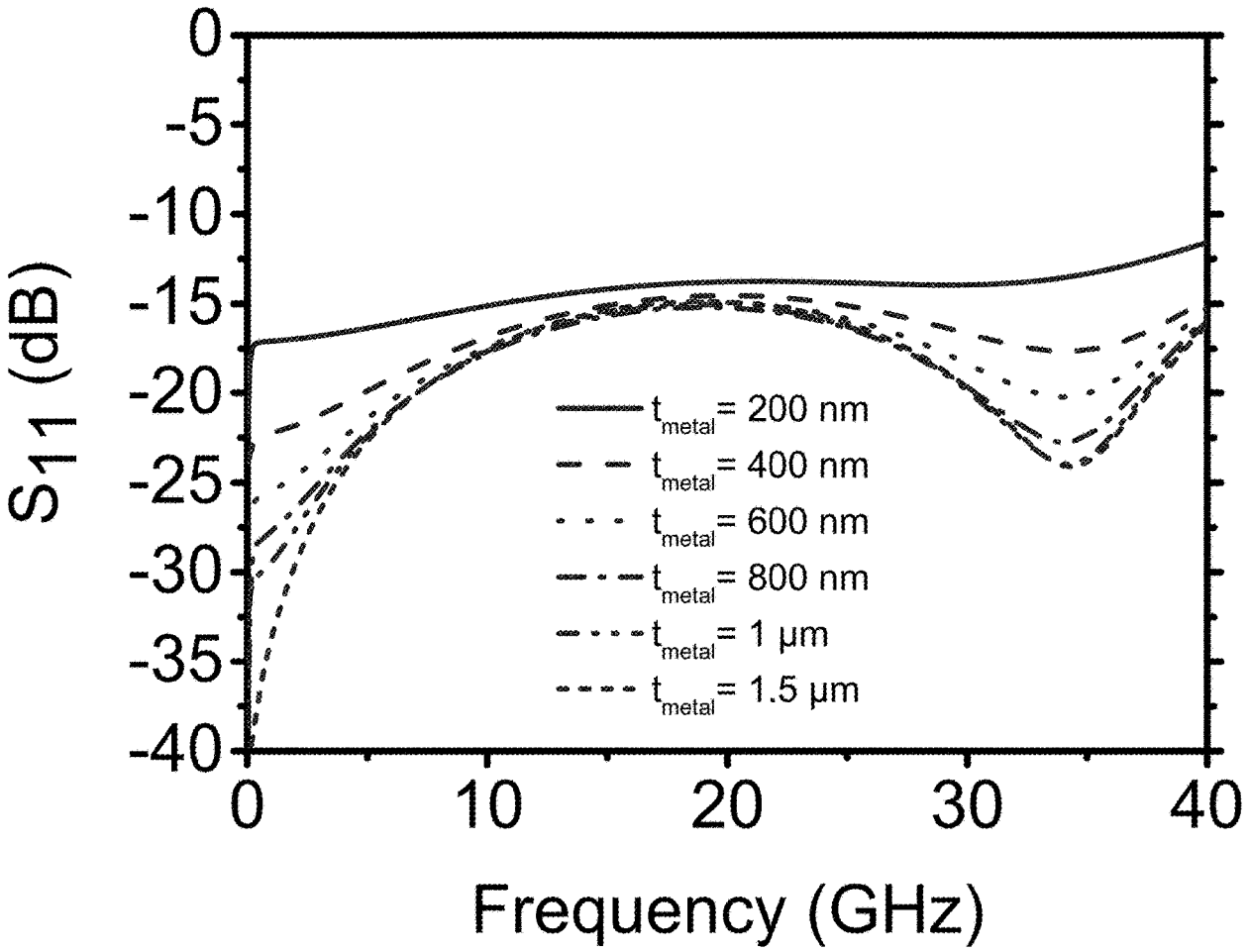
FIG. 10B. Simulated $S_{11}$ against frequency for signal thickness variations for the stretchable microstrip transmission line. Losses are enhanced with increasing thickness and saturate at 1 μm. Optimal signal thickness is 1 μm.
Figure 10C:
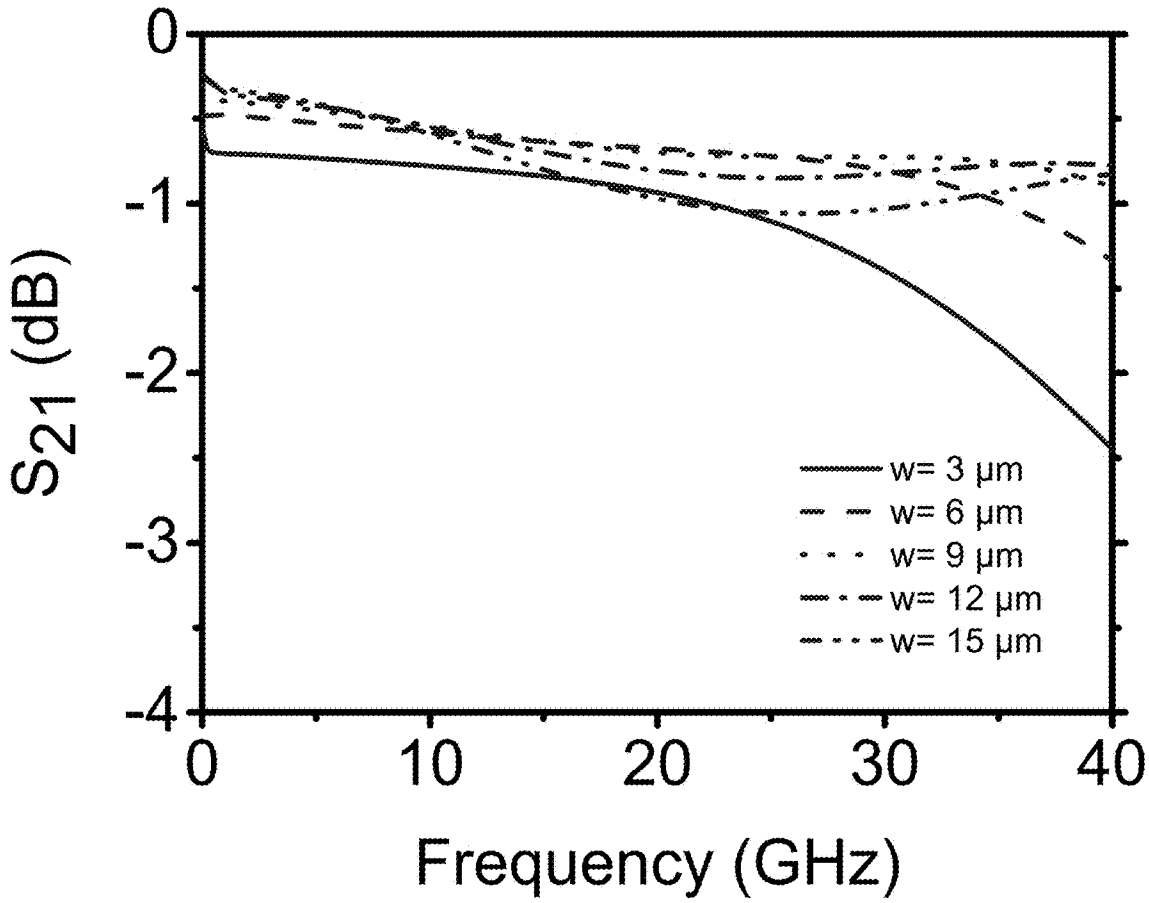
FIG. 10C. Simulated $S_{21}$ against frequency for signal width variations, with ground width fixed to 25 μm, for a stretchable microstrip transmission line.
Figure 10D:
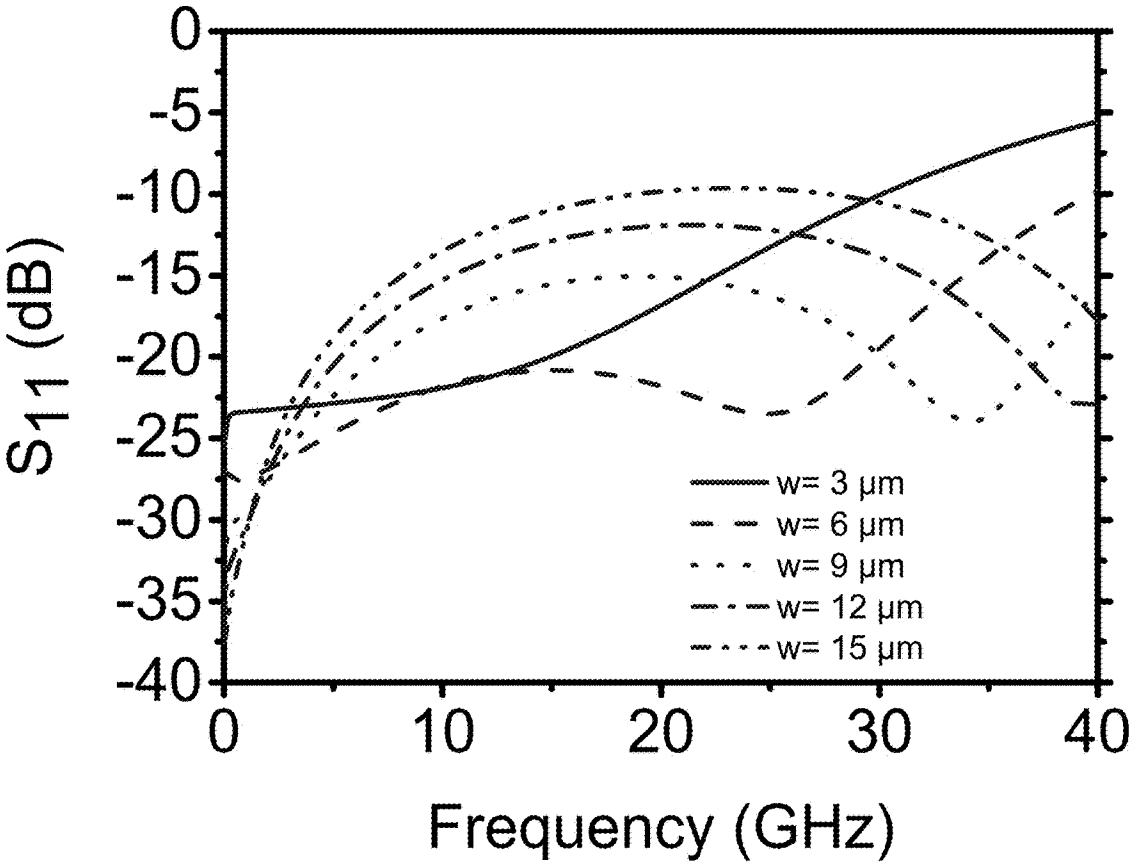
FIG. 10D. Simulated $S_{11}$ against frequency for signal width variations, with ground width fixed to 25 μm, for the stretchable microstrip transmission line. Optimal signal width is 9 μm.
Figure 10E:
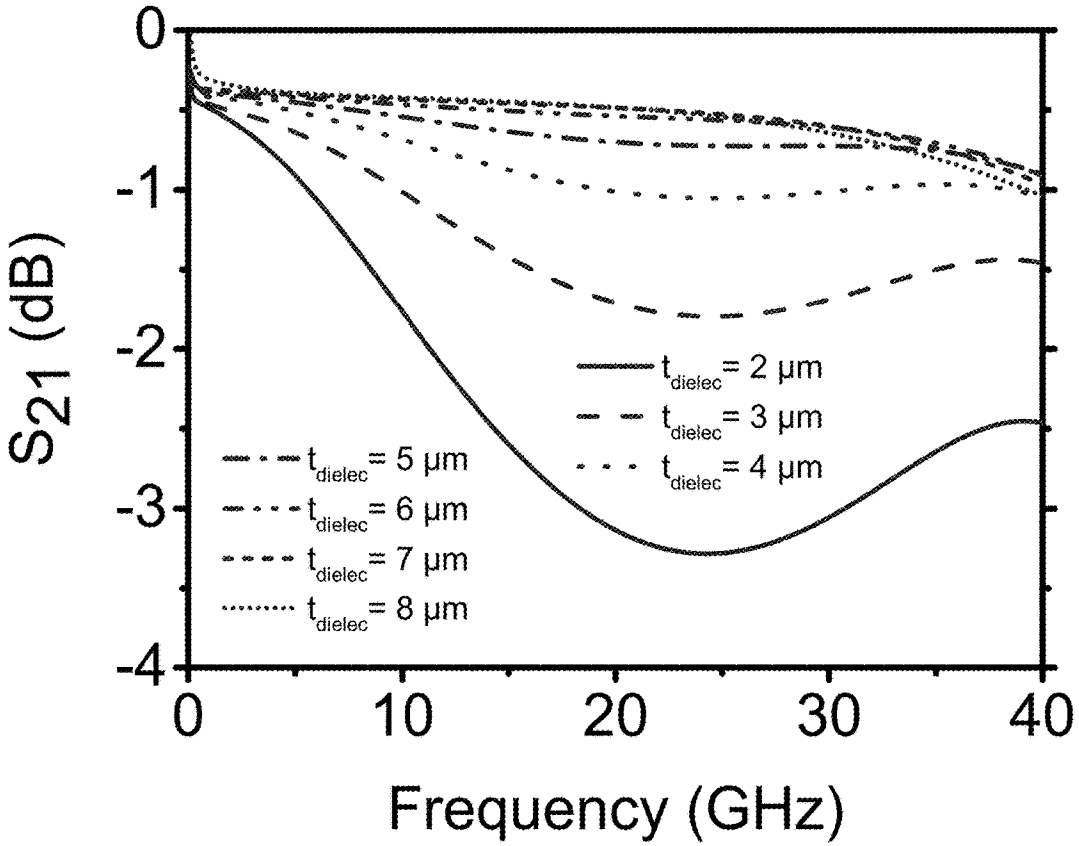
FIG. 10E. Simulated $S_{21}$ against frequency for dielectric spacing thickness variations for a stretchable microstrip transmission line.
Figure 10F:
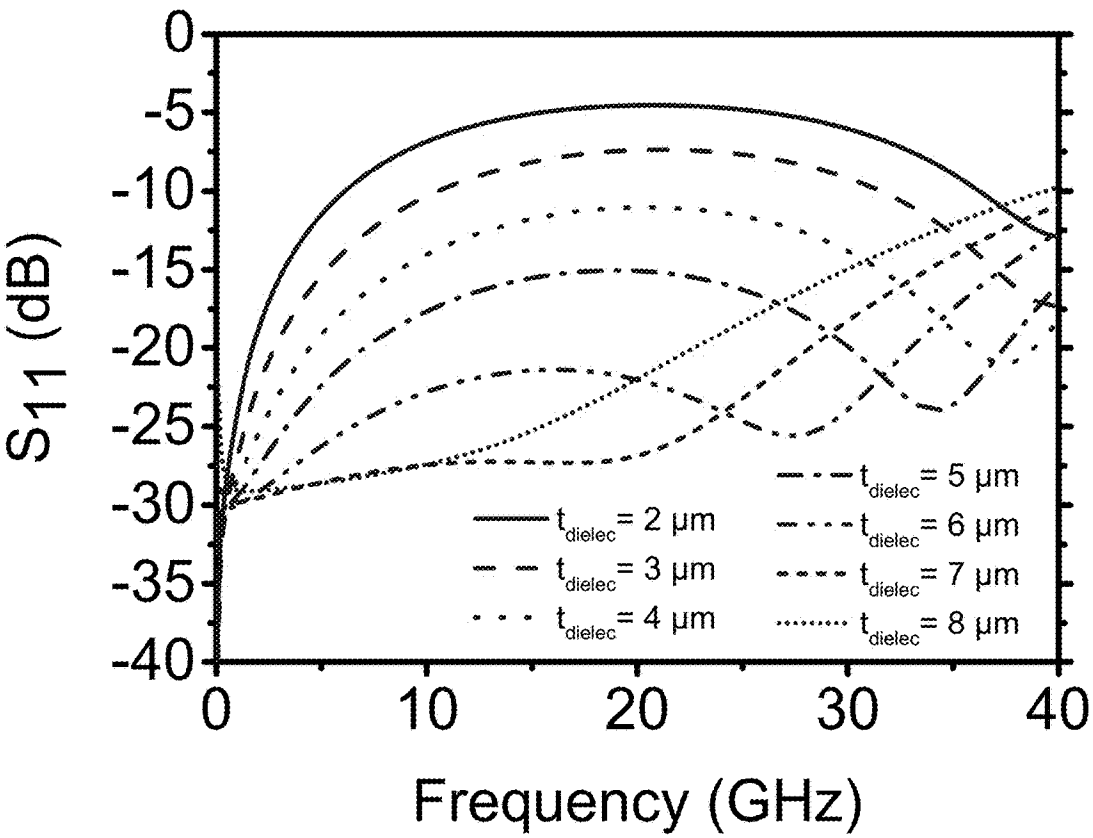
FIG. 10F. Simulated $S_{11}$ against frequency for dielectric spacing thickness variations for the stretchable microstrip transmission line. Optimal spacing thickness is 5 μm.
Figure 11A:
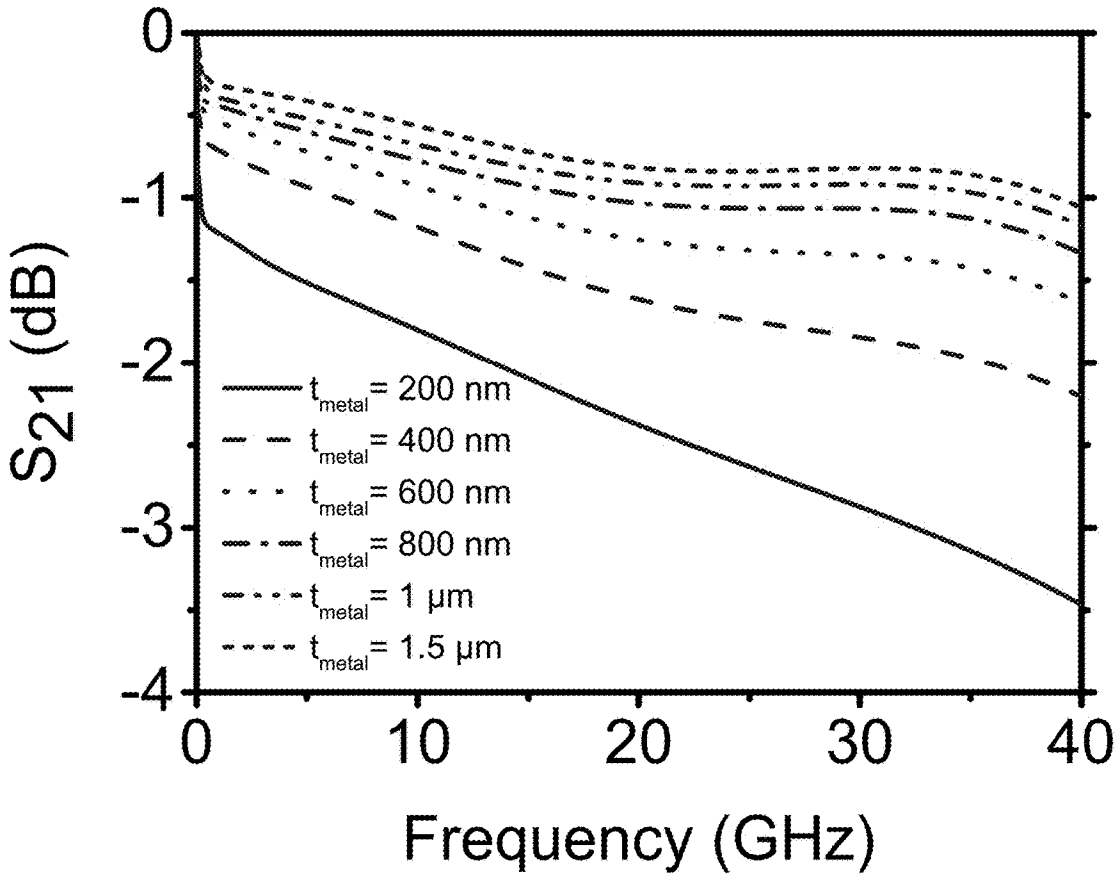
FIG. 11A. Simulated $S_{21}$ against frequency for signal thickness variations for a twisted-pair transmission line. Losses are enhanced with increasing thickness and saturate at 1 μm.
Figure 11B:
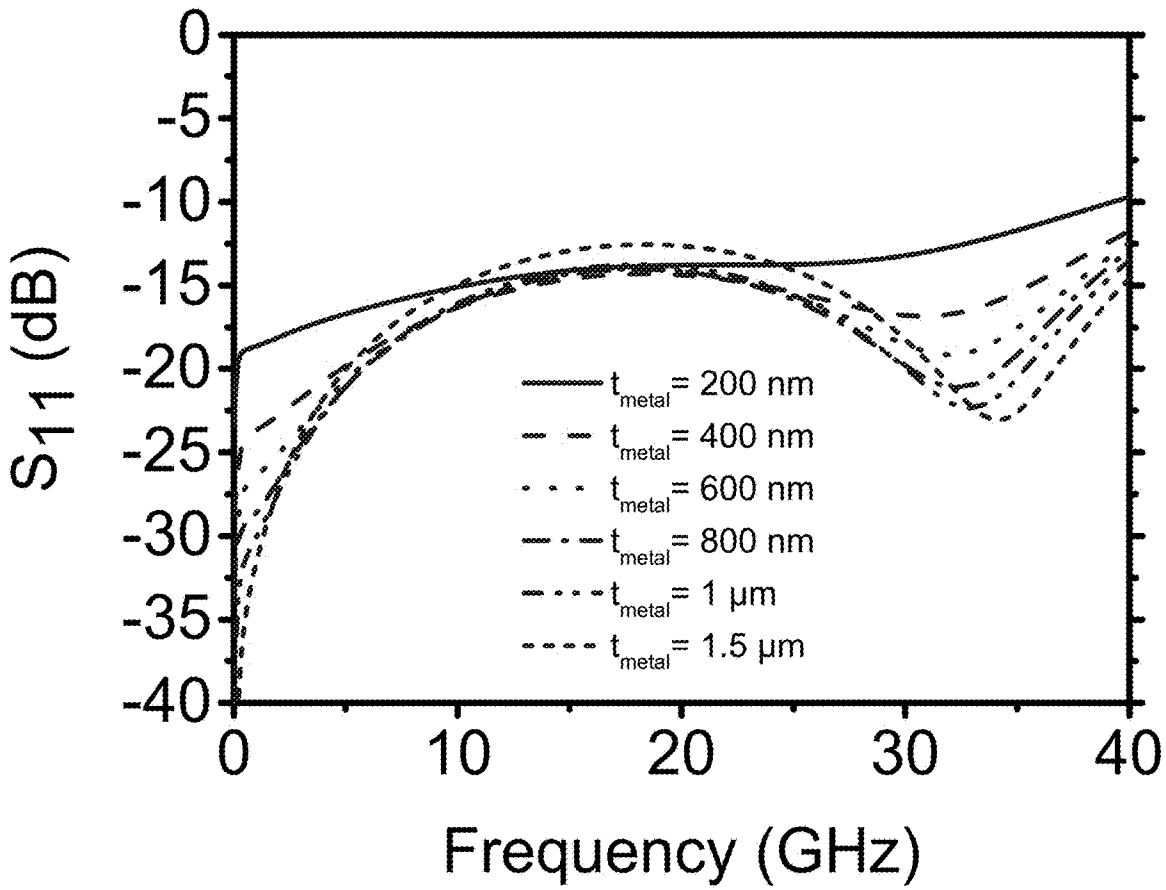
FIG. 11B. Simulated $S_{11}$ against frequency for signal thickness variations for the twisted-pair transmission line. Losses are enhanced with increasing thickness and saturate at 1 μm. Optimal signal thickness is 1 μm.
Figure 11C:
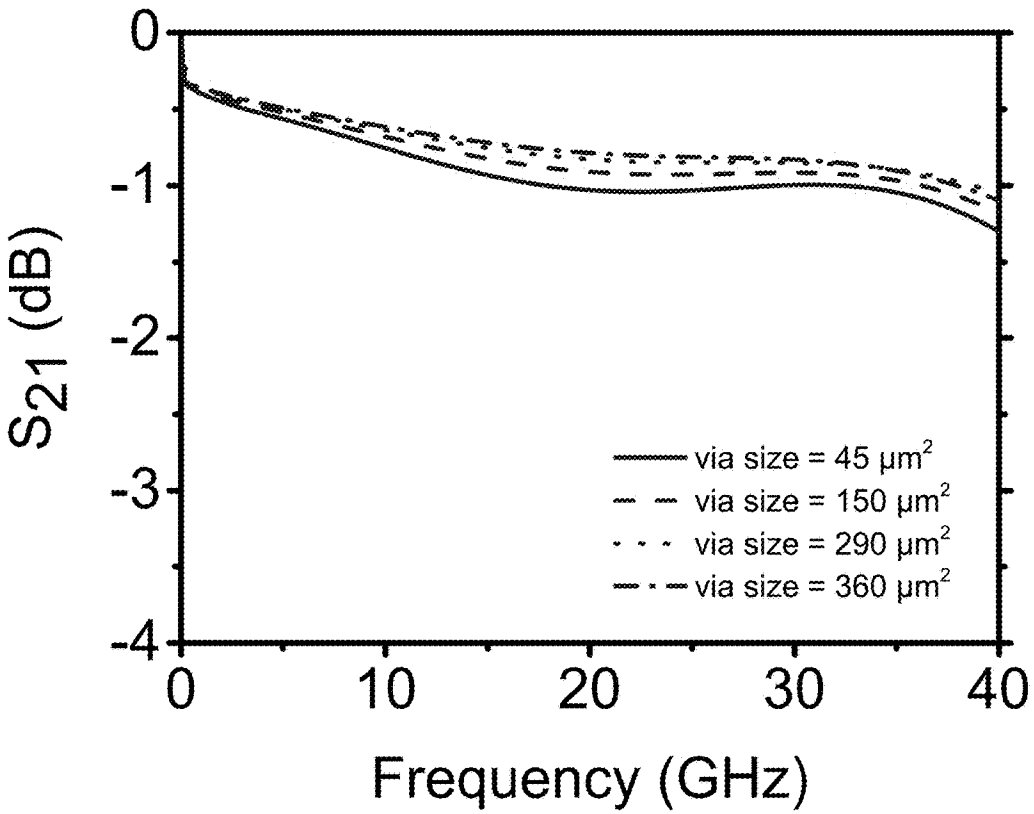
FIG. 11C. Simulated $S_{21}$ against frequency for via-hole size variations for a twisted-pair transmission line. Losses are enhanced with increasing size and saturate at 150 $\mu m^2$.
Figure 11D:
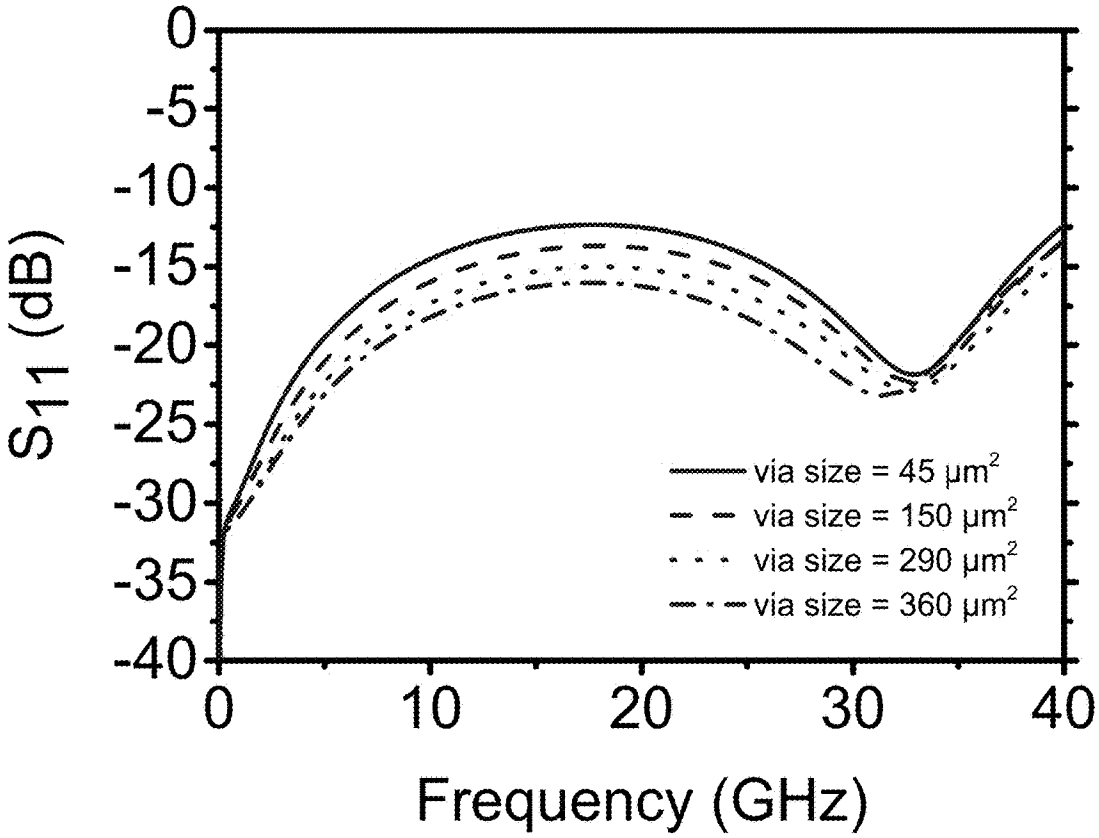
FIG. 11D. Simulated $S_{11}$ against frequency for via-hole size variations for the twisted-pair transmission line. Losses are enhanced with increasing size and saturate at 150 $\mu m^2$. Optimal via-hole size is 150 $\mu m^2$.
Figure 11E:
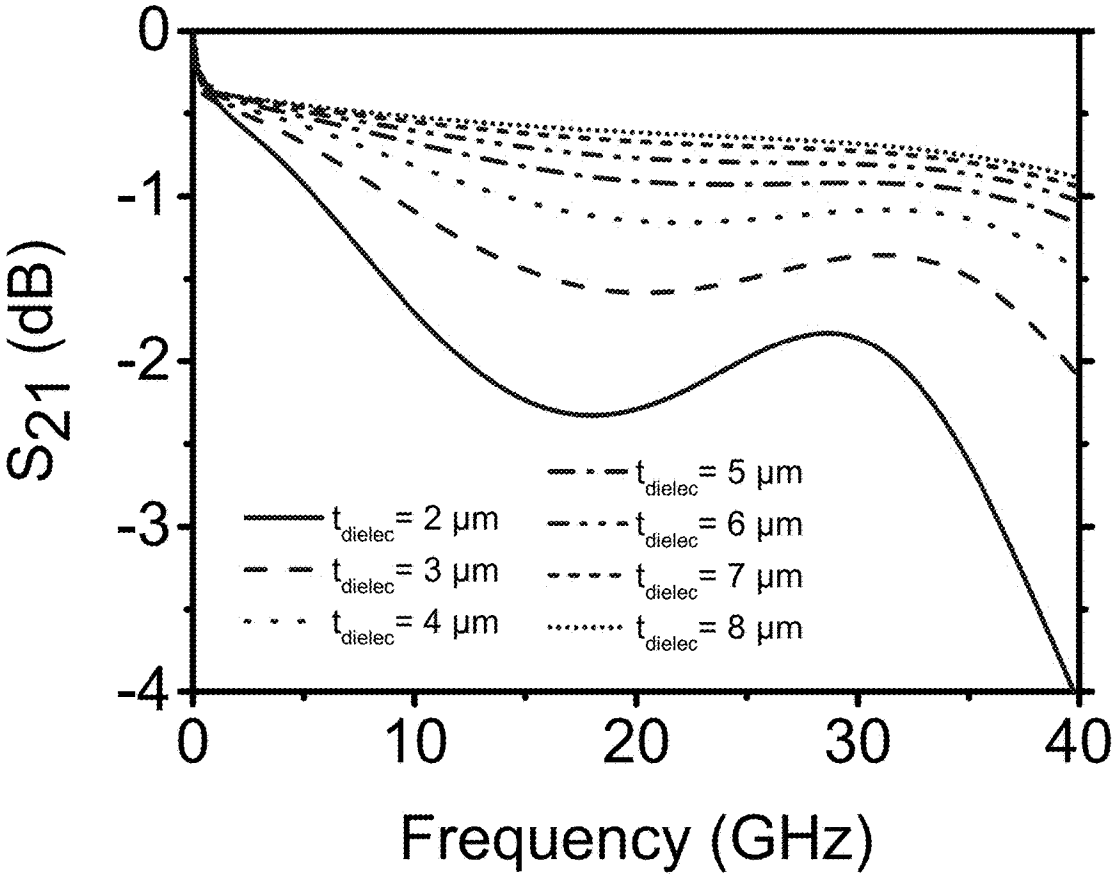
FIG. 11E. Simulated $S_{21}$ against frequency for dielectric spacing thickness variations for a twisted pair transmission line. Losses are enhanced with increasing thickness.
Figure 11F:
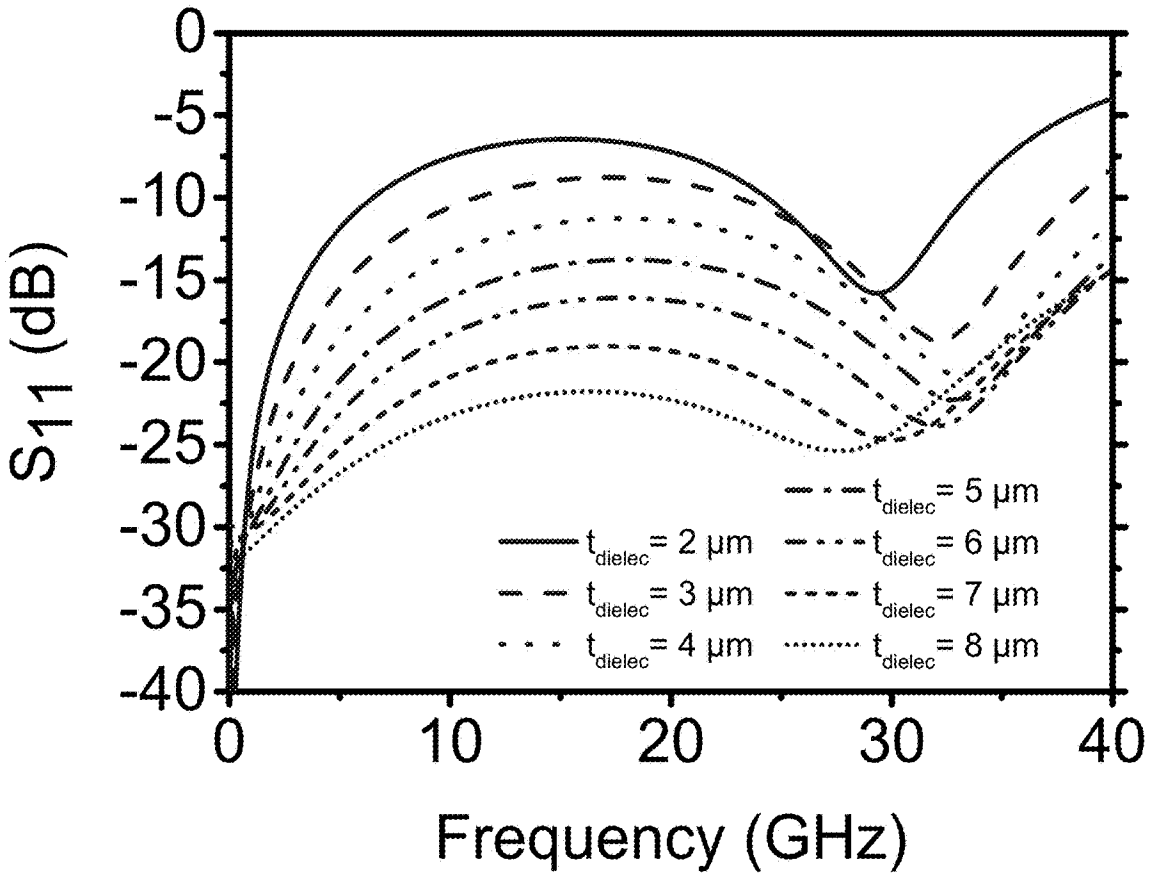
FIG. 11F. Simulated $S_{21}$ against frequency for dielectric spacing thickness variations for the twisted pair transmission line. Losses are enhanced with increasing thickness. Optimal spacing thickness is 5 μm, as thicker lines are incompatible with thin-film fabrication process.

To demonstrate the advantages of the twisted-pair-based stretchable transmission line, it was compared with other types of transmission lines, including a single layer and a (quasi) microstrip-based transmission line, in terms of RF loss, radiation confinement and mechanical stability via simulations, as presented in FIGS. 7A-C, 8A-C and 9A-C. For each line, the total length was fixed to 960 μm and all other dimensions were optimized for RF loss characteristics. For the microstrip-based line (FIGS. 7B, 8B, and 9B), the ground line width was fixed to 25 μm and the signal line thickness, signal line width, and dielectric spacer thickness were optimized to be 1 μm, 9 μm, and 5 μm, respectively. For the twisted-pair-based line (FIGS. 7C, 8C, and 9C), the widths of the signal and grounds lines were fixed to 25 μm and the thicknesses of the signal and ground lines, via-hole size, and elastomeric dielectric spacer thickness were optimized to be 1 μm, 150 $\mu m^2$, and 5μm, respectively. Detailed simulation comparisons against variants of the addressed optimization parameters for microstrip- and twisted-pair-based transmission lines are presented in FIGS. 10A-10F and FIGS. 11A-11F, respectively. In FIGS. 5, 4, and 1A, schematic illustrations presenting the structures of the single layer transmission line (also referred to as a coplanar strip transmission line), microstrip-based transmission line, and twisted-pair-based transmission line, respectively, used for each simulation are shown. FIGS. 7A-7C show simulated S-parameters from 0 to 40 GHz for each transmission line. Because a RF transmission line must be accompanied by a ground conductor, a conventional single conductor line is not capable of transmitting signals, but is simply a radiator (antenna) at high frequencies. The simplest way to remedy the high RF loss (radiation) of the single line conductive signal strip for possible RF signal transmission was to parallel it with another conductor at a small distance with a conductive ground strip. Such coplanar strip transmission lines (FIGS. 7A, 8A, and 9A) can be considered as differential transmission lines (i.e. ground line running parallel to the signal line). Simulations were performed on the simple transmission lines in terms of separation distance variants (d=1, 3, 5, and 10 μm) between a signal line and a ground line that have widths of 11 μm. As presented, the insertion loss and return loss showed acceptable performance at EHF only when the two conductors were as close as 1 μm, whereas the lines became too lossy with over 3 μm of separation distance. Both the microstrip-based and the twisted-pair-based transmission lines showed superior performance with low insertion loss (only −0.86 dB and −1.14 dB at 40 GHz, respectively) and high return loss up to 40 GHz, which are attributed to the excellent confinement of the high-frequency waves in the structures. FIGS. 8A-8C show the cross-section view of electric field calculations at 40 GHz for each line type. Unlike microwave transmission lines in conventional chips, the radiation confinement can be especially critical for EES, as the electronics are in close proximity with the skin that may induce interference. Therefore, structures with low levels of radiation and minimal EMI are desired. For the differential line, the fields were well-confined for a 1 μm separation (note: the conductor thickness was also 1 μm), but the fields deviated out severely as the separation distance increased. The fields in the microstrip-based lines were generally well-confined in between the signal line and the ground line, but had a tendency to deviate out randomly in spikes. In contrast, the fields in the twisted-pair-based transmission line were well-confined within the structure with smooth deviation around the line. This well-confined behavior of the electric fields is attributed to the suppressed radiated emission from the reduced loop area formed between signal and ground lines in the balanced twisted-pair structure. Furthermore, to demonstrate the mechanical stability, a finite element method was used to calculate the von Mises stress of each structure encapsulated with polyimide as shown in FIGS. 9A-9C. With equivalent tensile force applied to each line, more stress was observed at the edge of the serpentine path in the single layer line than at the edges of the microstrip- and twisted-pair-based lines. Thus, for a transmission line that always require two conductors (signal and ground), use of a single layered parallel line structure may be unfavorable in terms of mechanical stability. Moreover, compared to the asymmetric structure of the microstrip-based line, the symmetric structure of the twisted-pair puts the neutral plane in the center of the line.

Figure 12I:
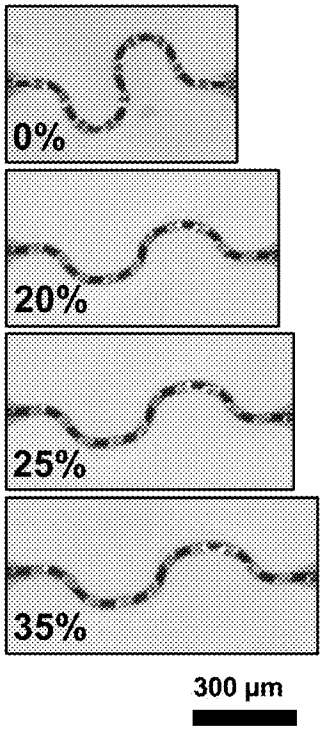
FIG. 12I. OM images of the stretchable transmission line with two turns at 0% (first (top) panel), 20% (second panel), 25% (third panel), and 35% elongation (fourth (bottom) panel).
Figure 12B:
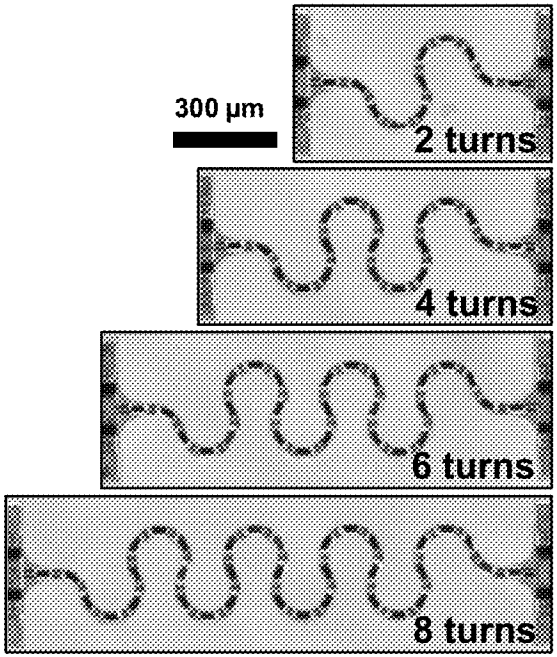
FIG. 12B. Optical microscopy (OM) images of the stretchable transmission lines with different lengths. Four lines with 2, 4, 6, and 8 turns of serpentine are shown from top to bottom.
Figure 13B:
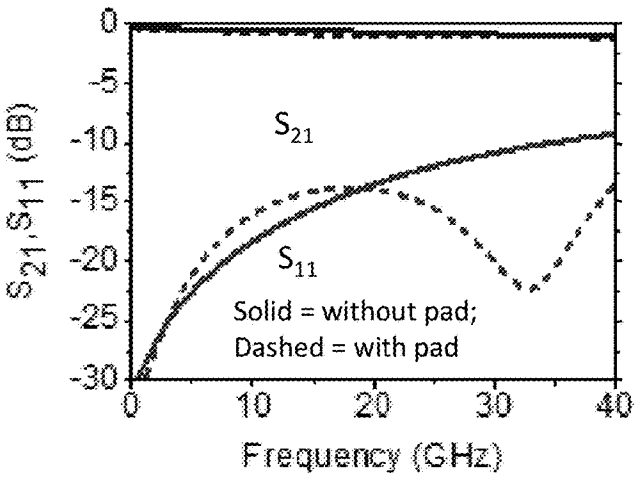
FIG. 13B. Scattering parameters simulation of the twisted-pair transmission line shown in FIG. 13A, compared against the line without the pads.
Figure 13A:
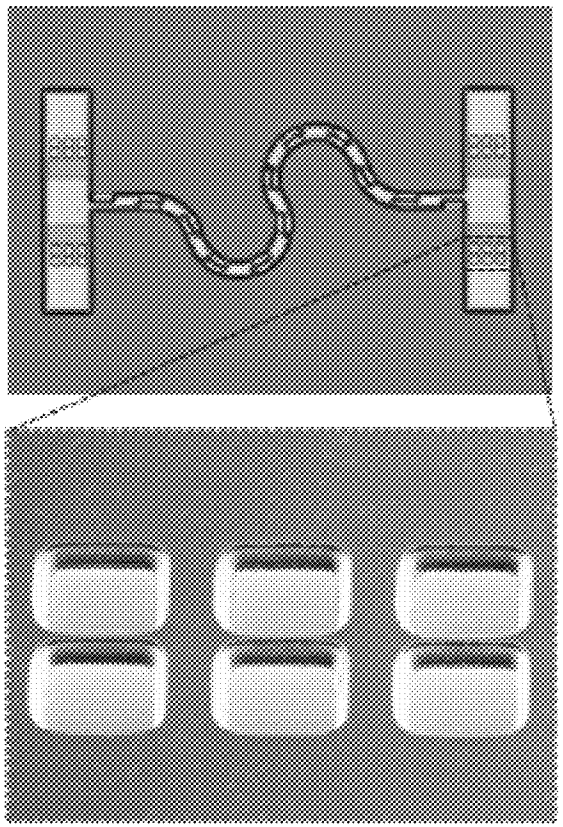
FIG. 13A. Optical microscopy image (top panel) showing a stretchable twisted-pair transmission line with ground-signal-ground measurement pads on both sides. Scanning electron microscopy image (bottom panel) of the via-holes in the pads connecting the grounds.

Experimental results for the fabricated twisted-pair-based stretchable transmission line are presented in FIG. 12A-12I. Precise conductor dimensions and spacings that carried signals with minimal reflections and power losses to achieve the best performance and results that matched the simulations are presented in FIG. 12A. Electrical characterization of transmission lines having four different lengths demonstrated the feasibility of short and long transmission lines at EHF. They were defined by the number of serpentine turns within the line as optically shown in FIG. 12B; for instance, the line with two turns has two "horseshoe" shaped serpentine structures. Clearly, the DC resistance values increased with line length (FIG. 12C). In addition, more insertion loss (FIG. 12D), due to resistive loss and dielectric loss, was observed in longer lines. Changes in return loss (FIG. 12E) followed a similar trend of increasing loss with length up to −10 GHz, but started to lose that trend as the frequency rose, due to the mismatch losses at high-frequencies. Regardless of the trend, all of the transmission lines exhibited good lossless characteristics at high-frequencies. Measurement pads designed to minimize radiation loss and to fit with ground-signal-ground (G-S-G) RF probes induced negligible loss to the transmission lines, as presented in FIGS. 13A and 13B. In order to investigate the effects of elongation, the RF performance of the twisted-pair-based line with two turns was measured at different degrees of elongation (0%, 20%, 25%, and 35%), as presented in FIGS. 12F-12I. RF measurements under stretched conditions were performed on a modified probe station with the stretcher mounted. Negligible increases in insertion loss were observed, as shown in FIG. 12F, which are attributed to the slight increase in the electrical resistance due to strain. Also, negligible performance change in return loss (FIG. 12G) characteristics were observed during elongation. The S-parameters of the transmission line were invariant even after 100 cycles of 35% elongation (FIG. 12H). OM images of the measured transmission line at different degrees of elongation are presented in FIG. 14I. At 40% elongation, a physical breaking occurred. Microstrip-based lines were also fabricated and analyzed as presented in FIGS. 15A-15F.

Figure 14A:
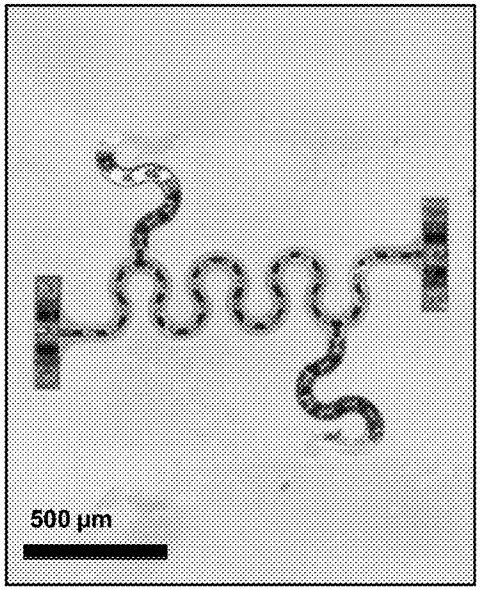
FIG. 14A. OM image of a twisted-pair-based stretchable low-pass filter.
Figure 14D:
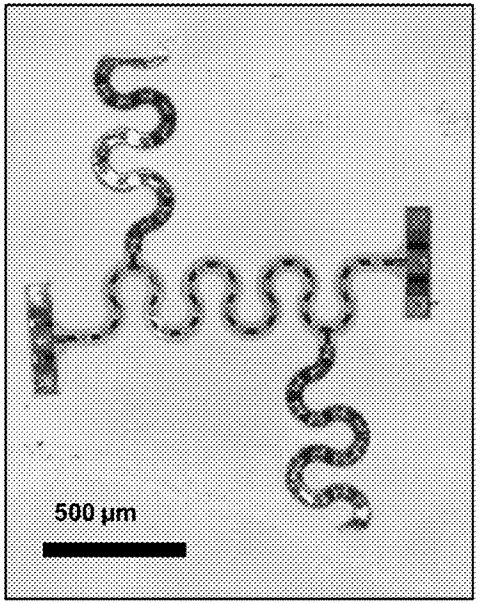
FIG. 14D. OM image of a twisted-pair-based stretchable band-stop filter.
Figure 14I:
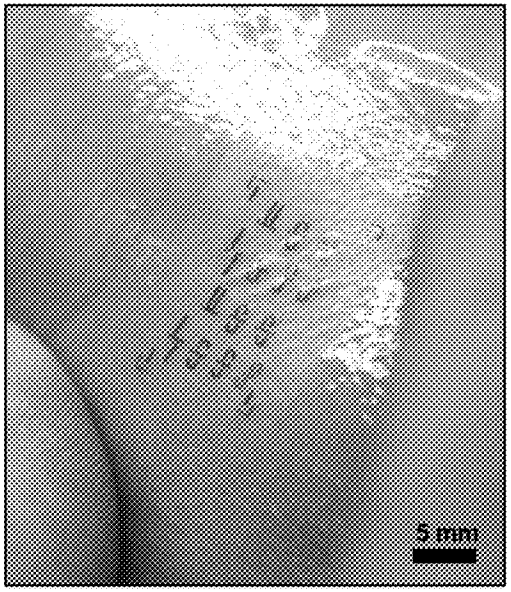
FIG. 14I. Image of the stretchable filters laminated and stretched on the back of a hand.
Figure 14C:
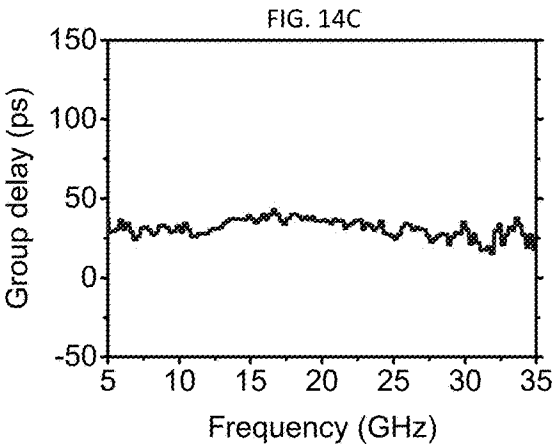
FIG. 14C. Group delay of the stretchable low-pass filter plotted against frequency.
Figure 14B:
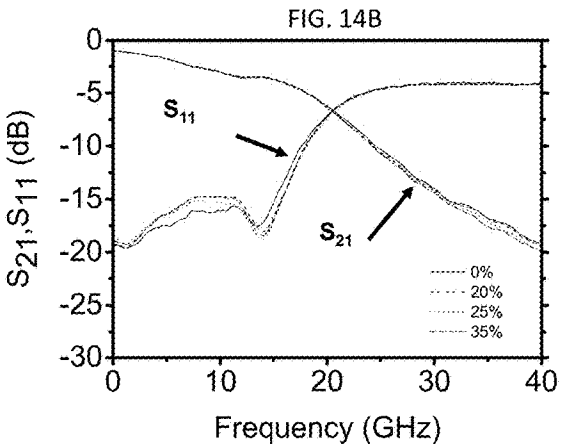
FIG. 14B. Scattering (S-) parameters of the stretchable low-pass filter at 0%, 20%, 25%, and 35% elongation plotted against frequency.
Figure 14F:
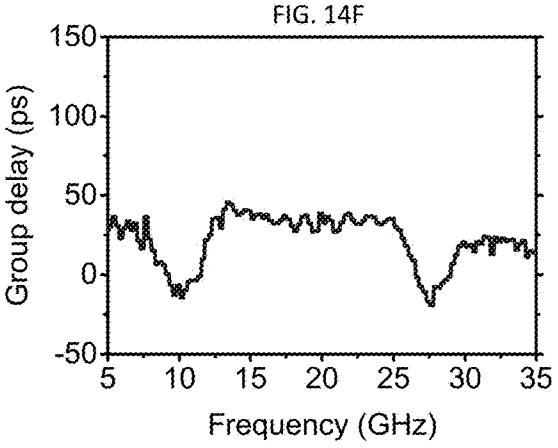
FIG. 14F. Group delay of the stretchable band-stop filter plotted against frequency.
Figure 14E:
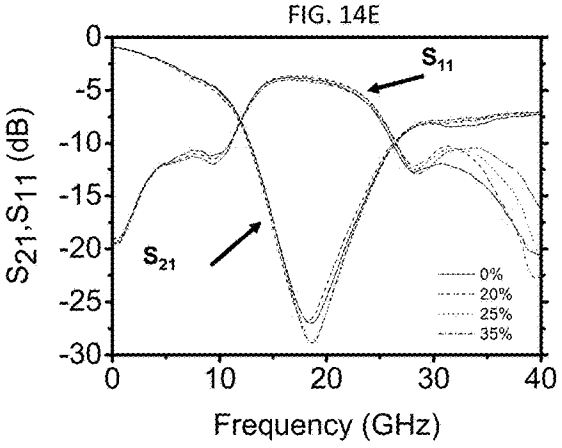
FIG. 14E. S-parameters of the stretchable band-stop filter at 0%, 20%, 25%, and 35% elongation plotted against frequency.
Figure 14G:
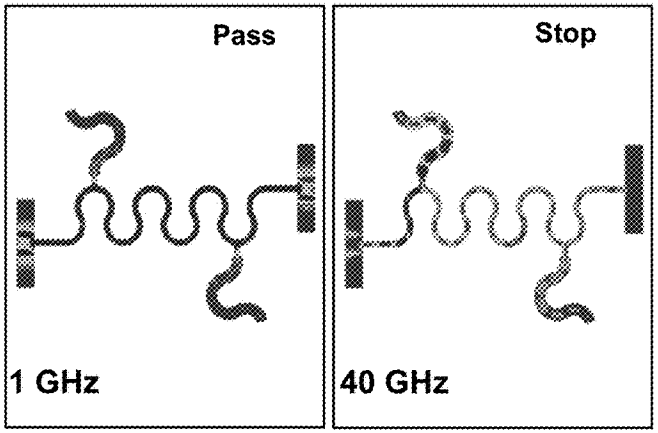
FIG. 14G. Simulated surface current density distribution in the stretchable low-pass filter at 1 GHz (pass) and 40 GHz (stop).
Figure 14H:
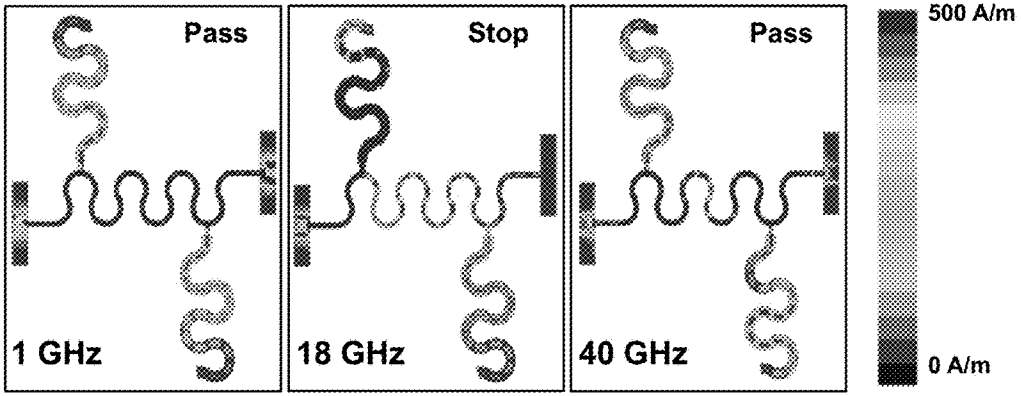
FIG. 14H. Simulated surface current density distribution in the stretchable band-stop filter at 1 GHz (pass), 18 GHz (stop), and 40 GHz (pass). Shaded bar on the right is for both FIG. 14G and FIG. 14H.
Figure 15B:
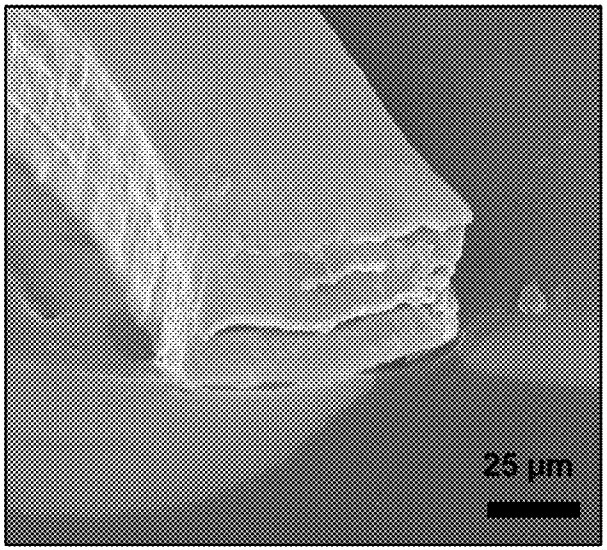
FIG. 15B. False-colored scanning electron microscopy image showing a lateral cross-sectional view of the microstrip structure embedded in polyimide.
Figure 15A:
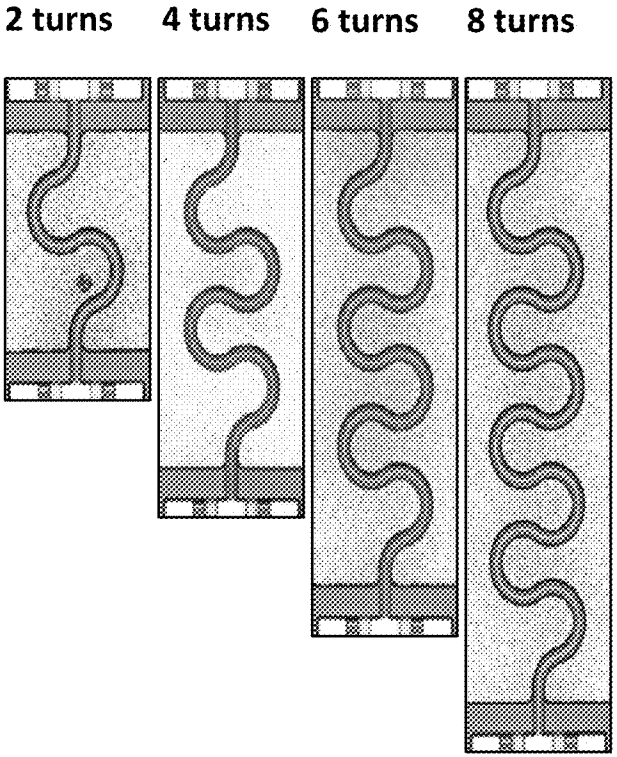
FIG. 15A. OM images of stretchable microstrip transmission lines with different lengths. Four transmission lines with 2, 4, 6, and 8 turns are shown from left to right.
Figure 15C:
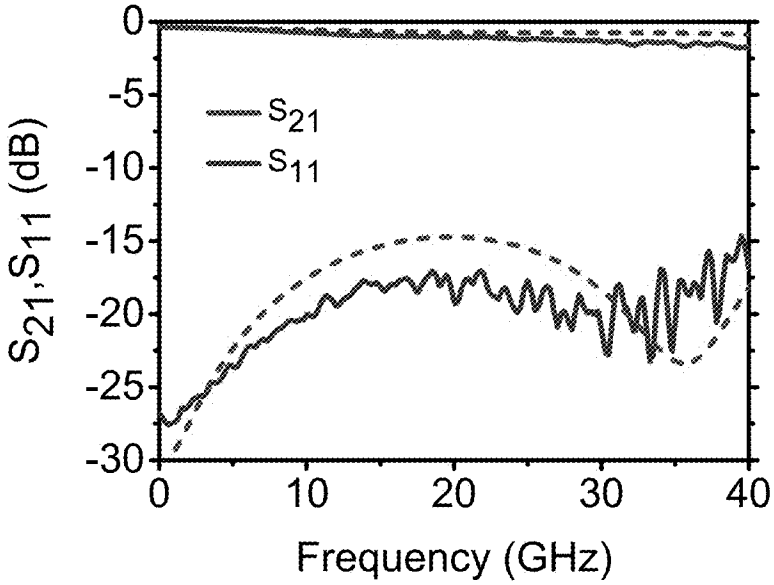
FIG. 15C. Simulated (dotted) and measured (solid) scattering (S-) parameters of the microstrip transmission line with two turns plotted against frequency.
Figure 15D:
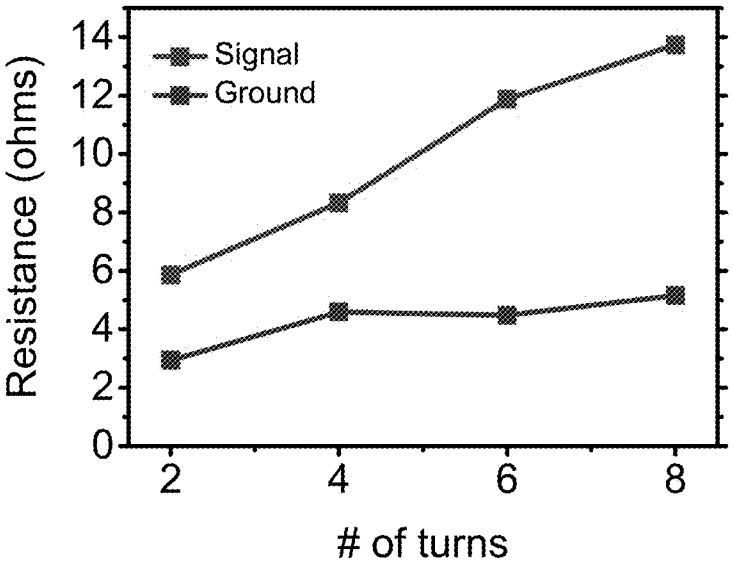
FIG. 15D. DC resistance values measured for signal and ground lines plotted for the four transmission lines with different numbers of turns.
Figure 15F:
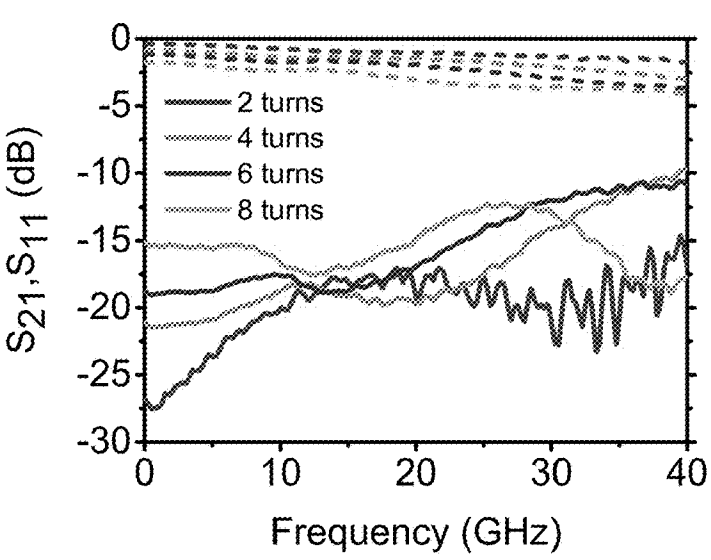
FIG. 15F. Measured S-parameters for the microstrip-based stretchable transmission line with two turns at 0%, 20%, 25%, and 35% elongation, plotted against frequency. $S_{21}$ and $S_{11}$ are shown in dotted and solid lines, respectively.
Figure 15E:
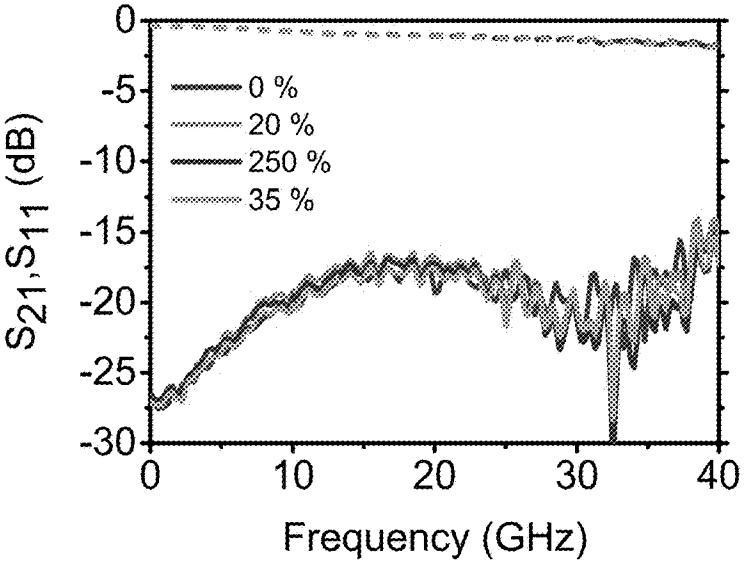
FIG. 15E. Measured S-parameters for the four transmission lines with different numbers of turns plotted against frequency. $S_{21}$ and $S_{11}$ are shown in dotted and solid lines, respectively.
Figure 16A:
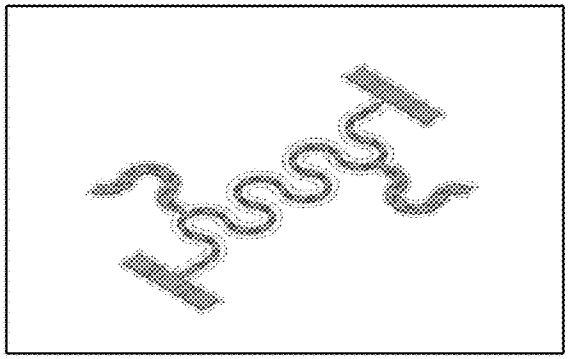
FIG. 16A. Computer-aided design (CAD) showing the equivalent structure of the low-pass filter used for surface current density calculation in FIG. 12G.
Figure 16B:
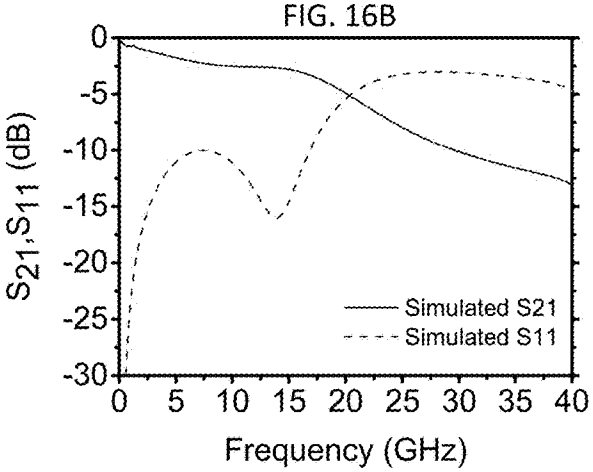
FIG. 16B. Simulated scattering (S-) parameters of the low-pass filter shown in FIG. 16A.
Figure 16C:
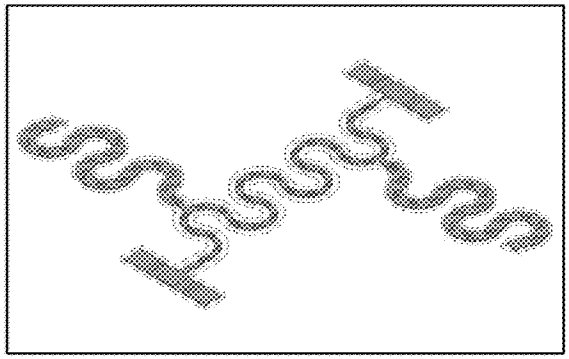
FIG. 16C. CAD showing the equivalent structure of the band-stop filter used for surface current density calculation in FIG. 12H.
Figure 16D:
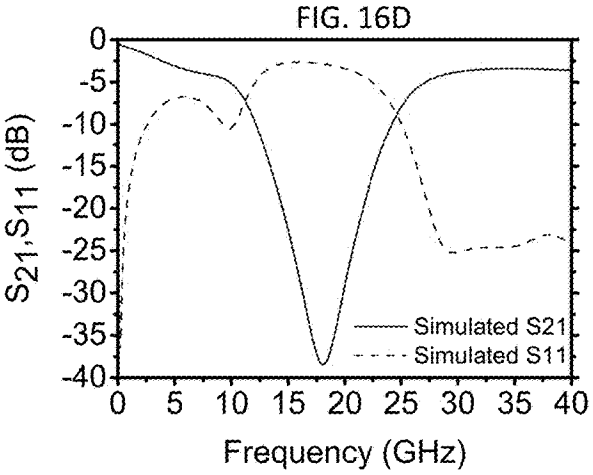
FIG. 16D. Simulated S-parameters of the band-stop filter shown in FIG. 16C.

In most microwave circuits, RF filters are used to attenuate or transmit signals at certain frequency bands. To demonstrate the practicality of the twisted-pair-based stretchable transmission line as such passive components, microwave filters were fabricated and tested, as presented in FIGS. 14A-14I. Despite the complex geometry of the twisted-pair, filters can be created by treating the transmission line as a distributed element component, which allows a relatively straightforward approach to fabricating filters. Instead of adding short lengths of matching stubs, as in conventional microstrip-based filters, blocks of twisted-pair lines in serpentine form were added to the sides of a main transmission line to generate resonance at stop or pass frequencies. As a result, two commonly used filters, a low-pass filter and a band-stop filter, were achieved as a tapped edge-couple filter structure. For the low-pass filter shown in FIG. 14A, each stub length was 575 μm. As presented in FIG. 14B, it exhibited a wide band low-pass characteristic where the 3 dB cut-off frequency was 17.2 GHz, with a relatively flat band and low insertion loss between 7.1 GHz (−3.64 dB) and 12.4 GHz (−3.91 dB). Relatively consistent group delay responses were observed in the flat pass-band, as presented in FIG. 14C. The center frequency of the band-stop filter with 1.45 mm in stub length (FIG. 14D) was 17.5 GHz and its insertion loss was −6.02 dB, as presented in FIG. 14E. The stop bandwidth was between 13 GHz (−5.41 dB) and 22 GHz (−9.07 dB). The group delay in FIG. 14F exhibited a uniform and flat response of approximately 27.6 ps in the stop band, which represents good robustness against signal distortion. Surface current density distributions in the low-pass filter and the band-stop filter at pass- and stop-band frequencies provide a clear view of the current concentrations as presented in FIGS. 14G and 14H, respectively. The calculated S-parameters of the equivalent designs used for the current distribution calculations are presented in FIG. 16A through 16D. The ability to create stretchable filters which operate at high-frequencies demonstrate the feasibility of the twisted-pair-based stretchable transmission lines in microwave integrated circuits for wearable electronics. FIG. 14I shows a set of twisted-pair-based stretchable filters laminated and stretched on the back of hand.

In summary, the results presented here establish the design and fabrication techniques for stretchable transmission lines that operate at EHF, which are suitable as interconnects in EES requiring high-speed wireless communication capabilities. Miniaturized stretchable transmission lines utilizing twisted-pair designs that have low RF and radiation loss were demonstrated and analyzed. Furthermore, stretchable microwave low-pass filter and band-stop filter were demonstrated using twisted-pair structures to show the feasibility of the twisted-pair-based transmission lines as passive components. This type of line is also applicable for high-speed digital circuits where the data rate is extremely high that require minimized interference from external noise. Together with already-developed EES that can perform various types of clinical sensing, such high-performance transmission lines in stretchable format can provide safe and remote monitoring of patients, through the development of high-speed wireless communication systems. The wireless capabilities represented by such transmission lines make their biomedical and other applications fully compatible with the need of the forthcoming internet of things.

Figure 17A:
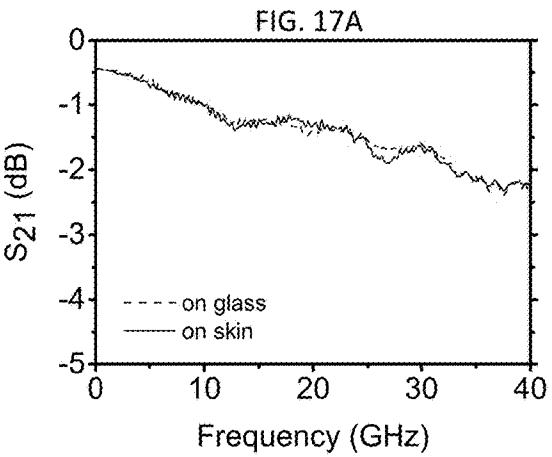
FIG. 17A. Measured $S_{21}$ of a stretchable transmission line with two turns on a glass substrate and on porcine skin plotted against frequency.
Figure 17B:
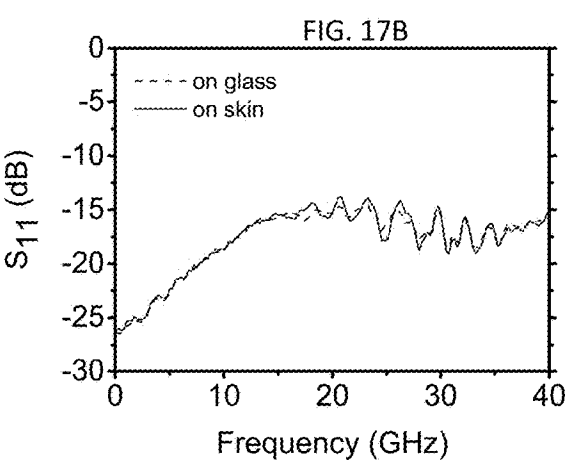
FIG. 17B. Measured $S_{11}$ of the stretchable transmission line with two turns on glass substrate and on porcine skin plotted against frequency.
Figure 17C:
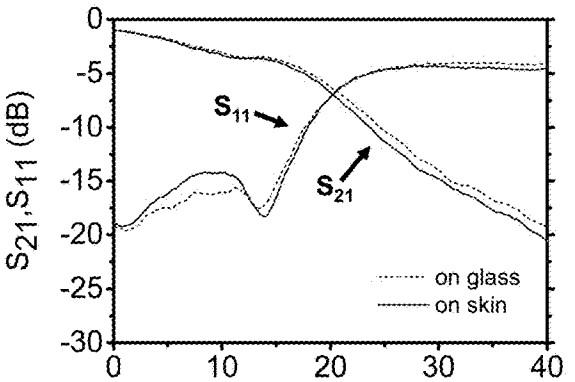
FIG. 17C. Measured Scattering (S-) parameters of a stretchable low-pass filter on a glass substrate and on porcine skin plotted against frequency.
Figure 17D:
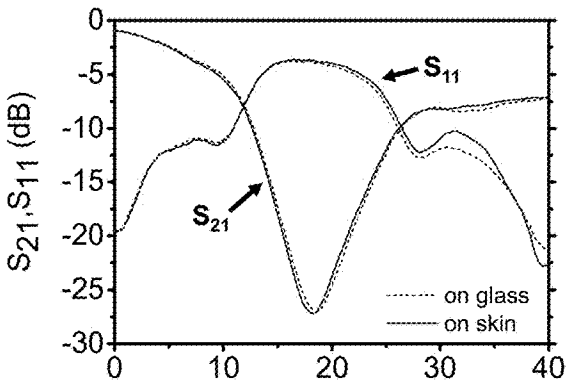
FIG. 17D. Measured S-parameters of a stretchable band-stop filter on a glass substrate and on porcine skin plotted against frequency.

The twisted-pair geometry should also suppress radiated emission and minimize interference with external noise, which would allow its operation without significant performance changes on unusual surfaces, such as the skin. To prove that the transmission line and filters can perform well on skin, their RF properties were measured on a porcine skin sample mounted onto the RF probe station. Porcine tissues were examined to best mimic the electrical properties of the human tissues at microwave frequencies. For instance, the permittivity, $\varepsilon_r$ and the conductivity, a of the porcine skin at 2.4 GHz are 38 and 1.46 S/m, respectively, which match closely to that of the human skin, where $\varepsilon_r$ and a are 40 and 1.6 S/m, respectively. For comparison, the devices were measured on glass slide and re-measured on a porcine skin. The measured S-parameters on skin were compared with the measured results on a glass substrate. As presented in FIGS. 17A and 17B, there were no significant changes in terms of insertion and return losses for a line with two turns measured on glass and skin. The stretchable low-pass filter and band-stop filter also showed negligible performance changes when measured on porcine skin, as shown in FIGS. 17C and 17D, respectively.

Experimental Section

Fabrication of Wearable Twisted-Pair-Based Stretchable Transmission Line:

On a temporary Si substrate, a thin layer of polymethyl methacrylate (950 PMMA A2, Microchem, 60 nm) was spin cast as a sacrificial polymer substrate, followed by hard baking at 180° C. for 3 min. A layer of polyimide (PI, Sigma-Aldrich, 5 μm) was spin cast two times at 2,500 rpm for 60 s, followed by soft baking at 150° C. for 4 min and hard baking at 350° C. under $N_2$ (4 Torr) ambient for 3 h. A first set of alternating ground line and signal line metal segments with fingers defining fingers (extensions) at their opposing longitudinal ends were deposited (Ti/Au=10/1,000 nm) using an electron-beam evaporator via a photoresist (AZ5214E) lift-off process, followed by spin casting and baking another layer of PI (5 μm) on top, to form the dielectric spacer. A hard mask (Cu=100 nm) was deposited to expose the via-holes, using a positive resist (S1813) based lift-off process for precision alignment of the holes. Isotropic reactive ion plasma etching (RIE, $CF_4/O_2$=2/80 sccm, pressure=75 mTorr, power=100 W) of the PI for 2 min opens the via-holes with side wall angle of 60°. A second set of alternating ground line and signal line metal (Ti/Au=10/1,000 nm) segments with fingers on their opposing longitudinal ends, but positioned with opposite sides relative to the fingers of the first set of line segments, was deposited using a lift-off process, followed by final passivation with PI (5 μm). Hard mask was formed with Cu (100 nm) by electron-beam evaporation via a lift-off process, followed by anisotropic reactive ion plasma etching (RIE, $O_2$=80 sccm, pressure=150 mTorr, power=200 W) of PI (total 15 μm) for 4 h, to define the serpentine shape of the line. The twisted-pair-based stretchable transmission lines on the temporary substrate were boiled in acetone at 200° C. for 30 min to remove the underlying sacrificial layer (PMMA). A water-soluble cellulose tape (3M) was laminated on the dried transmission lines and carefully picked up from the temporary substrate. A thin layer of oxide ($Ti/SiO_2$=5/50 nm) was deposited on the backside of the transmission lines. Stretchable modified silicone (Ecoflex 00-30, Smooth-On Inc.) for the substrate was prepared by mixing (part A:part B=1:1) and spin casting on a Si substrate at 500 rpm for 60 s, followed by curing at room temperature for 6 h. The fully cured Ecoflex was exposed with UV/ozone (UV-1, Samco, $O_2$=0.5 L/min) for 1 min, followed by immediate lamination of the cellulose tape with the stretchable transmission lines on the Ecoflex substrate. One hour after the lamination, a strong covalent bond formed between the Ecoflex and the oxide, which was immersed in water for 30 min to dissolve the tape.

Measurement and Analysis:

DC resistance of the stretchable transmission lines was measured using an HP 4155B Semiconductor Parameter Analyzer. An Agilent E8364A PNA Series Network Analyzer was used to measure the S-parameter of the stretchable transmission lines with the measurement set-up calibrated to the Infinity G-S-G probe tips with 150 μm pitch using a standard Short-Open-Load-Thru (SOLT) calibration kit. The S-parameters obtained from the RF measurements were analyzed using the Advanced Design System (ADS) software. The RF characteristics and the radiation characteristics of the stretchable transmission lines were simulated using the Ansys High-frequency Structural Simulator (HFSS) software and the mechanical finite element method (FEM) simulations were performed using the COMSOL multiphysics modeling software.

Example 2: Microcoaxial Transmission Line

This example illustrates the design and fabrication of a microcoaxial high-frequency transmission lines with low RF and radiation losses for EES. The fabrication steps are illustrated in FIG. 3A, panels (a) through (i).

On a temporary Si substrate, a thin layer of polymethyl methacrylate (not shown) is coated as a sacrificial polymer. A layer of polyimide, a dielectric material, is coated onto the upper surface of the polymethyl methacrylate substrate (panel a). The metal line that forms the bottom ground strip is deposited using an electron-beam evaporator via a photoresist lift-off process (panel b), followed by coating another layer of polyimide on top of the bottom ground strip, to form the lower dielectric spacer (panel c). Then a metal line that forms the signal line is deposited using an electron-beam evaporator via a photoresist lift-off process (panel d), followed by coating another layer of polyimide on top of the signal line, to form a upper dielectric spacer (panel e). A hard mask using a metal layer is then deposited to expose via-holes along the edge of the bottom ground strip using a photoresist lift-off process. Dry etching with oxygen and carbon tetrafluoride gases opens the via-holes and constructs the isotropic profile of the side wall for the via-holes (panel f). The metal film that forms the top strip and the side walls of the ground line conduit is deposited using an electron-beam evaporator via a photoresist lift-off process (panel g), followed by final passivation with another layer polyimide (panel h). A hard mask is formed with a metal by electron-beam evaporator via a lift-off process, followed by anisotropic dry etching of the serpentine shape of the line (panel i). The resulting microcoaxial transmission line on the temporary substrate is boiled in acetone to remove the underlying sacrificial layer. A water-soluble cellulose tape is laminated on the dried transmission line and it is carefully picked up from the temporary substrate. A thin layer of oxide is deposited on the backside of the transmission line. A stretchable modified silicone is used for the substrate and is prepared by spin casting on a Si substrate, followed by curing at room temperature. The fully cured silicone is exposed with UV/ozone, followed by immediate lamination of the cellulose tape with the stretchable transmission line on the silicone substrate. After lamination, a strong covalent bond is formed between the silicone and oxide, which is then immersed in water to dissolve the tape.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more".

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A twisted pair transmission line comprising:

a signal line comprising:

a first set of electrically conductive signal line segments, wherein the signal line segments in the first set are spaced apart along a first serpentine path; and a second set of electrically conductive signal line segments, wherein the signal line segments in the second set are spaced apart along a second serpentine path that has the same shape as, but is disposed above, the first serpentine path; and a plurality of signal line electrical interconnects that connect the signal line segments in the first set to the signal line segments in the second set in an alternating arrangement, such that the first set of signal line segments, the second set of signal line segments and the signal line electrical interconnects form an electrically conductive signal line;

a ground line comprising:

a first set of electrically conductive ground line segments, wherein the ground line segments in the first set are spaced apart along the first serpentine path in an alternating arrangement with the signal line segments in the first set of signal line segments; and a second set of electrically conductive ground line segments, wherein the ground line segments in the second set are spaced apart along the second serpentine path in an alternating arrangement with the signal line segments in the second set of signal line segments; and a plurality of ground line electrical interconnects that connect the ground line segments in the first set to the ground line segments in the second set in an alternating arrangement, such that the first set of ground line segments, the second set of ground line segments and the ground line electrical interconnects form an electrically conductive ground line that is entwined with the signal line; and a dielectric material that encapsulates the signal line and the ground line and that separates the first set of signal line segments from the second set of signal line segments and also separates the first set of ground line segments from the second set of ground line segments, wherein the signal line electrical interconnects and the ground line electrical interconnects extend through the dielectric material between the first sets of signal and ground line segments and the second sets of signal and ground line segments;

the transmission line being configured to transmit a signal with microwave frequencies of 40 GHz and higher with a maximum insertion loss of −0.01 dB per μm and a minimum return loss of at least −0.01 dB per μm at a frequency of 40 GHz, a temperature of 23° C., and a characteristic impedance of 50 ohms.

2. The transmission line of claim 1, wherein the signal line segments and the ground line segments each comprise at least one longitudinal extension; the ground line segments in the first set are spaced apart along the first serpentine path in an alternating and interdigitated arrangement with the signal line segments in the first set of signal line segments; and the ground line segments in the second set are spaced apart along the second serpentine path in an alternating and interdigitated arrangement with the signal line segments in the second set of signal line segments.

3. The transmission line of claim 1, wherein the transmission line has a maximum insertion loss of −0.0015 dB per μm and a minimum return loss of −0.013 dB per μm at a frequency of 40 GHz, a temperature of 23° C., and a characteristic impedance of 50 ohms.

4. The transmission line of claim 1, wherein: the signal line segments and the ground line segments have thicknesses of no greater than 10 μm and widths of no greater than 1000 μm; the first set of signal line segments and the first set of ground line segments are spaced apart vertically from the second set of signal line segments and the second set of ground line segments by a distance in the range from 4 μm to 8 μm; and the signal and ground line electrical interconnects have cross-sectional areas of at least 5 μm2.

5. The transmission line of claim 1, wherein: the signal line segments and the ground line segments have thicknesses of no greater than 1 μm and widths of no greater than 25 μm; the first set of signal line segments and the first set of ground line segments are spaced apart vertically from the second set of signal line segments and the second set of ground line segments by a distance in the range from 4 μm to 6 μm; and the signal and ground line electrical interconnects have cross-sectional areas of at least 20 μm2.

6. The transmission line of claim 1, characterized in that it can be stretched to an elongation of 35% without breaking and further characterized in that its insertion loss and return loss at an elongation of 35% differ from its insertion loss and return loss in an unstretched state by no more than 15%.

7. A microwave filter comprising:

a main transmission line comprising a twisted-pair transmission line in accordance with claim 1; and at least two stub lines, each joined to the side of the main transmission line and each comprising a twisted-pair transmission line in accordance with claim 1, wherein the stub lines are configured to generate resonance at stop or pass frequencies when a microwave signal is being transmitted by the main transmission line.

8. A method of transmitting a high frequency signal, the method comprising transmitting a signal with microwave frequencies of 40 GHz or higher through a twisted pair transmission line comprising:

a signal line comprising:

a first set of electrically conductive signal line segments, wherein the signal line segments in the first set are spaced apart along a first serpentine path; and a second set of electrically conductive signal line segments, wherein the signal line segments in the second set are spaced apart along a second serpentine path that has the same shape as, but is disposed above, the first serpentine path; and a plurality of signal line electrical interconnects that connect the signal line segments in the first set to the signal line segments in the second set in an alternating arrangement, such that the first set of signal line segments, the second set of signal line segments and the signal line electrical interconnects form an electrically conductive signal line;

a ground line comprising:

a first set of electrically conductive ground line segments, wherein the ground line segments in the first set are spaced apart along the first serpentine path in an alternating arrangement with the signal line segments in the first set of signal line segments; and a second set of electrically conductive ground line segments, wherein the ground line segments in the second set are spaced apart along the second serpentine path in an alternating arrangement with the signal line segments in the second set of signal line segments; and a plurality of ground line electrical interconnects that connect the ground line segments in the first set to the ground line segments in the second set in an alternating arrangement, such that the first set of ground line segments, the second set of ground line segments and the ground line electrical interconnects form an electrically conductive ground line that is entwined with the signal line; and a dielectric material that encapsulates the signal line and the ground line and that separates the first set of signal line segments from the second set of signal line segments and also separates the first set of ground line segments from the second set of ground line segments, wherein the signal line electrical interconnects and the ground line electrical interconnects extend through the dielectric material between the first sets of signal and ground line segments and the second sets of signal and ground line segments;

the transmission line being configured to transmit a signal with microwave frequencies of 40 GHz and higher with a maximum insertion loss of −0.01 dB per μm and a minimum return loss of at least −0.01 dB per μm at a frequency of 40 GHz, a temperature of 23° C., and a characteristic impedance of 50 ohms, wherein the signal undergoes a maximum insertion loss of −0.01 dB per μm and a minimum return loss of at least −0.01 dB per μm over the length of the twisted pair transmission line.

9. A microscale microwave transmission line comprising:

a signal line comprising a metal strip having a thickness of no greater than 2 μm, a width in the range from 5 μm to 1000 μm, and a serpentine shape along its length;

a ground line comprising a metal strip having a thickness of no greater than 2 μm, a width in the range from 5 μm to 1000 μm, and the serpentine shape along its length, wherein the ground line runs parallel with the signal line; and a dielectric material encapsulating the signal line and the ground line along their lengths and separating the signal line from the ground line by a distance in the range from 0.5 μm to 5 μm;

the transmission line being configured to transmit a signal with microwave frequencies of 40 GHz and higher with a maximum insertion loss of −0.01 dB per μm and a minimum return loss of −0.005 dB per μm at a frequency of 40 GHz, a temperature of 23° C., and a characteristic impedance of 50 ohms.

10. The transmission line of claim 9, wherein the transmission line is a microcoaxial transmission line in which the ground line further comprises a first side wall, a second side wall, and a top strip, each of which comprises a metal film having a thickness of no greater than 2 μm, wherein the metal strip, first side wall, second side wall, and top strip of the ground line form a ground conduit that surrounds the signal line along its length and runs coaxially with the signal line.

11. The transmission line of claim 9, wherein the transmission line is a microstrip transmission line in which the ground line runs parallel with, and is vertically spaced apart from, the signal line, and further wherein the metal strip of the signal line is narrower than the metal strip of the ground line;

the transmission line having a minimum return loss of −0.01 dB per μm at a frequency of 40 GHz, a temperature of 23° C., and a characteristic impedance of 50 ohms.

12. The transmission line of claim 11, wherein the transmission line has a maximum insertion loss of −0.0009 dB per μm and a minimum return loss of −0.015 dB per μm at a frequency of 40 GHz, a temperature of 23° C., and a characteristic impedance of 50 ohms.

13. The transmission line of claim 11, wherein the metal strip of the signal line has a thickness of no greater than 2 μm and a width in the range from 5 μm to 300 μm, and the vertical spacing between the metal strip of the signal line and the metal strip of the ground line is in the range from 4 μm to 8 μm.

14. The transmission line of claim 13, wherein the metal strip of the signal line has a thickness of no greater than 1 μm and a width in the range from 6 μm to 12 μm, and the metal strip of the signal line is spaced apart from the metal strip of the ground line by a distance in the range from 4 μm to 6 μm.

15. The transmission line of claim 9, wherein the transmission line is a quasi-coplanar transmission line in which the ground line runs parallel with, and is laterally spaced apart from, the signal line, and further wherein the metal strips of the signal line and ground line have thicknesses of no greater than 2 μm and widths in the range from 5 μm to 300 μm, and the lateral spacing between the metal strip of the signal line and the metal strip of the ground line is no greater than 10 μm;

the transmission line having a maximum insertion loss of −0.0015 dB per μm and a minimum return loss of −0.005 dB per μm at a frequency of 40 GHz, a temperature of 23° C., and a characteristic impedance of 50 ohms.

16. A method of transmitting a high frequency signal, the method comprising transmitting a signal with microwave frequencies of 40 GHz or higher through a microscale microwave transmission line comprising:

a signal line comprising a metal strip having a thickness of no greater than 2 μm, a width in the range from 5 μm to 1000 μm, and a serpentine shape along its length;

a ground line comprising a metal strip having a thickness of no greater than 2 μm, a width in the range from 5 μm to 1000 μm, and the serpentine shape along its length, wherein the ground line runs parallel with the signal line; and a dielectric material encapsulating the signal line and the ground line along their lengths and separating the signal line from the ground line by a distance in the range from 0.5 μm to 5 μm;

the transmission line being configured to transmit a signal with microwave frequencies of 40 GHz and higher with a maximum insertion loss of −0.01 dB per μm and a minimum return loss of −0.005 dB per μm at a frequency of 40 GHz, a temperature of 23° C., and a characteristic impedance of 50 ohms, wherein the signal undergoes a maximum insertion loss of −0.01 dB per μm and a minimum return loss of −0.005 dB per μm over the length of the microscale microwave transmission line.

* * * * *